US006572133B1

(12) United States Patent
Stevens

(10) Patent No.: US 6,572,133 B1
(45) Date of Patent: Jun. 3, 2003

(54) FOLDING MECHANISM FOR A WHEELCHAIR

(75) Inventor: Rex W. Stevens, Erie, CO (US)

(73) Assignee: Sunrise Medical HHG, Inc., Longmont, CO (US)

( * ) Notice: Subject to any disclaimer, the term of this patent is extended or adjusted under 35 U.S.C. 154(b) by 0 days.

(21) Appl. No.: 09/965,285

(22) Filed: Sep. 27, 2001

Related U.S. Application Data

(60) Provisional application No. 06/262,482, filed on Jan. 18, 2001.

(51) Int. Cl.[7] ..... A61G 5/00

(52) U.S. Cl. ..... 280/642; 280/250.1; 297/42

(58) Field of Search ..... 280/250.1, 642, 280/304.1; 297/42, DIG. 4

(56) References Cited

U.S. PATENT DOCUMENTS

| | | | |
|---|---|---|---|
| 2,639,162 | A | 5/1953 | Schon |
| 2,884,046 | A | 4/1959 | Patrick |
| 4,082,348 | A | 4/1978 | Haury |
| 4,245,849 | A | 1/1981 | Thiboutot |
| RE30,867 | E | 2/1982 | Gaffney |
| 4,371,183 | A | 2/1983 | Dion |
| 4,500,102 | A | 2/1985 | Haury et al. |
| 4,542,918 | A | 9/1985 | Singleton |
| 4,555,121 | A | 11/1985 | Lockard et al. |
| 4,595,212 | A | 6/1986 | Haury et al. |
| 4,648,619 | A | 3/1987 | Jungnell et al. |
| 4,712,830 | A | 12/1987 | Charbrol et al. |
| 4,736,960 | A | 4/1988 | Batty et al. |
| 4,741,547 | A | 5/1988 | Tholkes |
| 4,805,931 | A | 2/1989 | Slasor |
| 4,813,693 | A | 3/1989 | Lockard et al. |
| 4,840,390 | A | 6/1989 | Lockard et al. |
| 4,861,056 | A | 8/1989 | Duffy, Jr. et al. |
| 4,887,826 | A | 12/1989 | Kantner |
| 4,934,722 | A | 6/1990 | Goetzelman |
| 4,989,890 | A | 2/1991 | Lockard et al. |
| 5,020,816 | A | 6/1991 | Mulholland |
| 5,076,390 | A | 12/1991 | Haskins |
| 5,188,383 | A | 2/1993 | Thompson |
| 5,197,559 | A | 3/1993 | Garin, III et al. |
| 5,301,970 | A | 4/1994 | Haskins |
| 5,328,183 | A | 7/1994 | Counts |
| 5,338,048 | A | 8/1994 | Medina |
| 5,564,786 | A | 10/1996 | Peek et al. |
| 5,593,173 | A | 1/1997 | Williamson |
| 5,664,798 | A | 9/1997 | Huang |
| 5,667,235 | A | 9/1997 | Pearce et al. |
| 5,727,802 | A | 3/1998 | Garven, Jr. et al. |
| 5,727,809 | A | 3/1998 | Ordelman et al. |
| 5,743,545 | A | 4/1998 | Kunze et al. |
| 5,758,897 | A | 6/1998 | Kueschall |
| 5,782,483 | A | 7/1998 | Rogers et al. |
| 5,791,672 | A | 8/1998 | Masclet |
| 5,915,709 | A | 6/1999 | Radjenovic et al. |
| 5,954,402 | A | 9/1999 | McInturff |
| 5,984,418 | A | 11/1999 | McInturff |
| 5,996,716 | A | 12/1999 | Montiglio et al. |
| 6,050,582 | A | 4/2000 | Horacek |
| 6,073,958 | A | 6/2000 | Gagnon |
| 6,079,725 | A | 6/2000 | Lazaros |
| 6,102,431 | A | 8/2000 | Sutherland et al. |
| 6,164,674 | A | 12/2000 | Rogers et al. |

FOREIGN PATENT DOCUMENTS

| | | | |
|---|---|---|---|
| EP | 0201423 | A1 * | 5/1986 |

* cited by examiner

*Primary Examiner*—Kevin Hurley
(74) *Attorney, Agent, or Firm*—MacMillan, Sobanski & Todd, LLC

(57) ABSTRACT

A wheelchair frame has first and second side frames, a slider housing, and a slider member mounted for movement relative to the slider housing. Links connect the slider housing to both the first and second side frames, and links connect the slider member to both the first and second side frames. Movement of the slider member relative to the slider housing actuates the links to change the spacing between the first and second side frames, thereby opening and closing the wheelchair frame.

29 Claims, 21 Drawing Sheets

FOLDING MECHANISM FOR A WHEELCHAIR

RELATED APPLICATIONS

This application claims priority from provisional patent application Serial No. 60/262,482, filed Jan. 18, 2001. This application may be related to U.S. patent application Ser. No. 09/965,347, filed Sep. 27, 2001.

TECHNICAL FIELD

This invention relates to a folding frame of the type useful as a support mechanism for wheelchairs. More particularly, the invention pertains to a chair or wheelchair frame that can be easily folded to a compact size for storage or transportation.

BACKGROUND OF THE INVENTION

Wheelchairs are well known forms of transportation that increase the mobility of the physically impaired. Wheelchairs are typically relatively small, single-person conveyances that generally comprise a seat supported by a frame which, in turn, is supported by two opposed drive wheels and two front casters. Many manual wheelchairs are designed so that they can be folded for more convenient storage when not in use. Typical folding mechanisms involve cross braces extending from an upper part of one side frame to a lower part of another side frame. The cross braces are often provided in a tubular form in a telescoping arrangement to allow the tubular cross braces to slide within each other during folding, and to allow adjustment of the length of the cross braces for width and height adjustment of the wheelchair when unfolded.

In U.S. Pat. No. 4,595,212 there is illustrated a wheelchair folding mechanism having upper and lower spacer members that pivot when a central folding frame is moved forward with respect to the side frames of the wheelchair.

In U.S. Pat. No. 4,595,212 there is illustrated a wheelchair folding mechanism having upper and lower spacer members that pivot when a central folding frame is moved forward with respect to the side frames of the wheelchair.

Despite the benefits of known folding wheelchair mechanisms, it would be advantageous if there could be developed a wheelchair folding mechanism that not only folds into a compact space, but also enables the frame to be opened into any one of several different widths as desired to fit the needs of the wheelchair user.

SUMMARY OF THE INVENTION

The above objects as well as other objects not specifically enumerated are achieved by a wheelchair frame having first and second side frames, a slider housing, and a slider member mounted for movement relative to the slider housing. Links connect the slider housing to both the first and second side frames, and links connect the slider member to both the first and second side frame side frames. Movement of the slider member relative to the slider housing actuates the links to change the spacing between the first and second side frames, thereby opening and closing the wheelchair frame.

According to this invention, there is also provided a wheelchair frame including first and second side frames, a slider housing, and a slider member mounted for movement relative to the slider housing. Links connect the slider housing to both the first and second side frames, and links connect the slider member to both the first and second side frame side frames. A stop in the form of a pin for limits the extent to which the slider member can be moved with respect to the slider housing, thereby establishing a minimum and maximum width of the wheelchair frame. The stop is seated in an orifice that is adjustable to any one of several predetermined locations on the slider member, with each of the locations corresponding to a different width of the wheelchair frame when the wheelchair frame is opened. Movement of the slider member relative to the slider housing actuates the links to change the spacing between the first and second side frames, thereby opening and closing the wheelchair frame.

According to this invention, there is also provided a wheelchair frame including first and second side frames, a slider housing, and a slider member mounted for movement relative to the slide housing. Links connect the slider housing and the slider member to both the first and second side frames. A biasing member connects the slider housing and the slider member. The biasing member biases the slider housing and slider member toward each other. Actuation of the links changes the spacing between the first and second side frames, thereby opening and closing the wheelchair frame, with the biasing member acting to open the wheelchair frame.

According to this invention, there is also provided a wheelchair frame including first and second side frames, and a slider positioned between the side frames. The slider is mounted for movement in forward and rearward directions with respect to the side frames. Eight links connect the slider to both the side frames so that movement of the slider relative to the side frames changes the spacing between the side frames, thereby opening and closing the wheelchair frame. Four of the links are positioned in four different horizontal planes on the right side of the wheelchair, and the other four of the links are mounted in four different horizontal planes on the left side of the wheelchair.

According to this invention, there is also provided a wheelchair frame including first and second side frames, and a slider positioned between the side frames. The slider is mounted for movement in forward and rearward directions with respect to the side frames. Links connect the slider to both the side frames so that movement of the slider relative to the side frames changes the spacing between the side frames, thereby opening and closing the wheelchair frame. A biasing member is connected to the slider. The biasing member biases the slider in a direction to open the wheelchair frame.

According to this invention there is also provided a wheelchair frame that includes first and second side frames, and a slider positioned between the side frames, the slider being mounted for movement in forward and rearward directions with respect to the side frames. Links connect the slider to both the side frames so that movement of the slider relative to the side frames changes the spacing between the side frames, thereby opening and closing the wheelchair frame. At least three links are positioned in separate horizontal planes on the right side of the wheelchair, and at least three links are mounted in separate horizontal planes on the left side of the wheelchair.

According to this invention there is also provided a wheelchair frame that has first and second side frames, and a slider positioned between the side frames, the slider being mounted for movement in forward and rearward directions with respect to the side frames. Links connect the slider to both the side frames so that movement of the slider relative to the side frames changes the spacing between the side frames, thereby opening and closing the wheelchair frame. A biasing member is connected to the slider. The biasing member biases the slider in a direction to open the wheelchair frame.

According to this invention there is also provided a wheelchair that is foldable to open and closed positions. The wheelchair includes first and second frame members that are movable with respect to each other during folding of the wheelchair. A biasing member is connected to at least one of the frame members. Movement of the frame members with respect to each other during folding of the wheelchair creates a biasing force in the biasing member urging the wheelchair to an open position.

According to this invention there is also provided a wheelchair that is foldable to open and closed positions. The wheelchair includes first and second frame members that are movable with respect to each other during folding and unfolding of the wheelchair. A handle is connected to the first frame member and mounted so that when the first frame member is urged upwardly by the handle, the second frame member is moved apart from the first frame member by the weight of the wheelchair. A biasing member is connected between the first and second frame members. Movement of the frame members apart from each other during folding of the wheelchair creates a biasing force in the biasing member urging the wheelchair to an open position.

Various objects and advantages of this invention will become apparent to those skilled in the art from the following detailed description of the preferred embodiments, when read in light of the accompanying drawings.

DETAILED DESCRIPTION OF THE INVENTION

Figure 1:
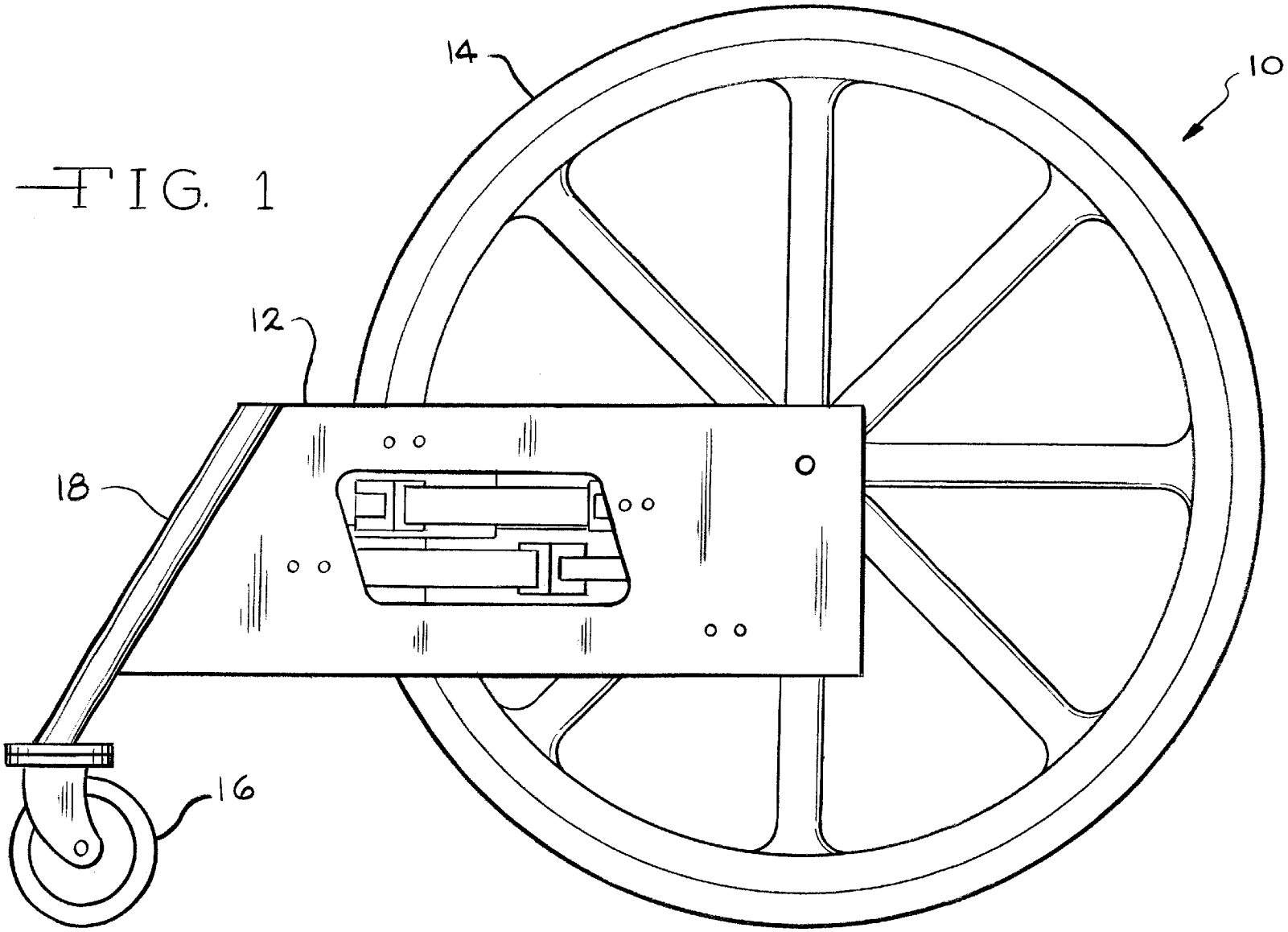
FIG. 1 is a schematic side view in elevation of a wheelchair that includes the folding wheelchair frame of the invention.

As shown in FIG. 1, the wheelchair, indicated generally at 10, includes first and second side frames 12, only one of which is shown in FIG. 1. Rear drive wheels 14, only one of which is shown in FIG. 1, are mounted for rotation with respect to the side frames 12. Only one of the drive wheels 14 is showing in FIG. 1. Front caster wheels 16 are mounted on the side frames 12 by means of a front tube 18, although numerous other mounting means can be used to mount the caster wheels 16. It is to be understood that the side frames 12 can be of any design or shape, but they are preferably light weight and made of a strong material, such as aluminum or a composite material. The seat, seat cushion, seat back and legrests are not shown.

Figure 2:
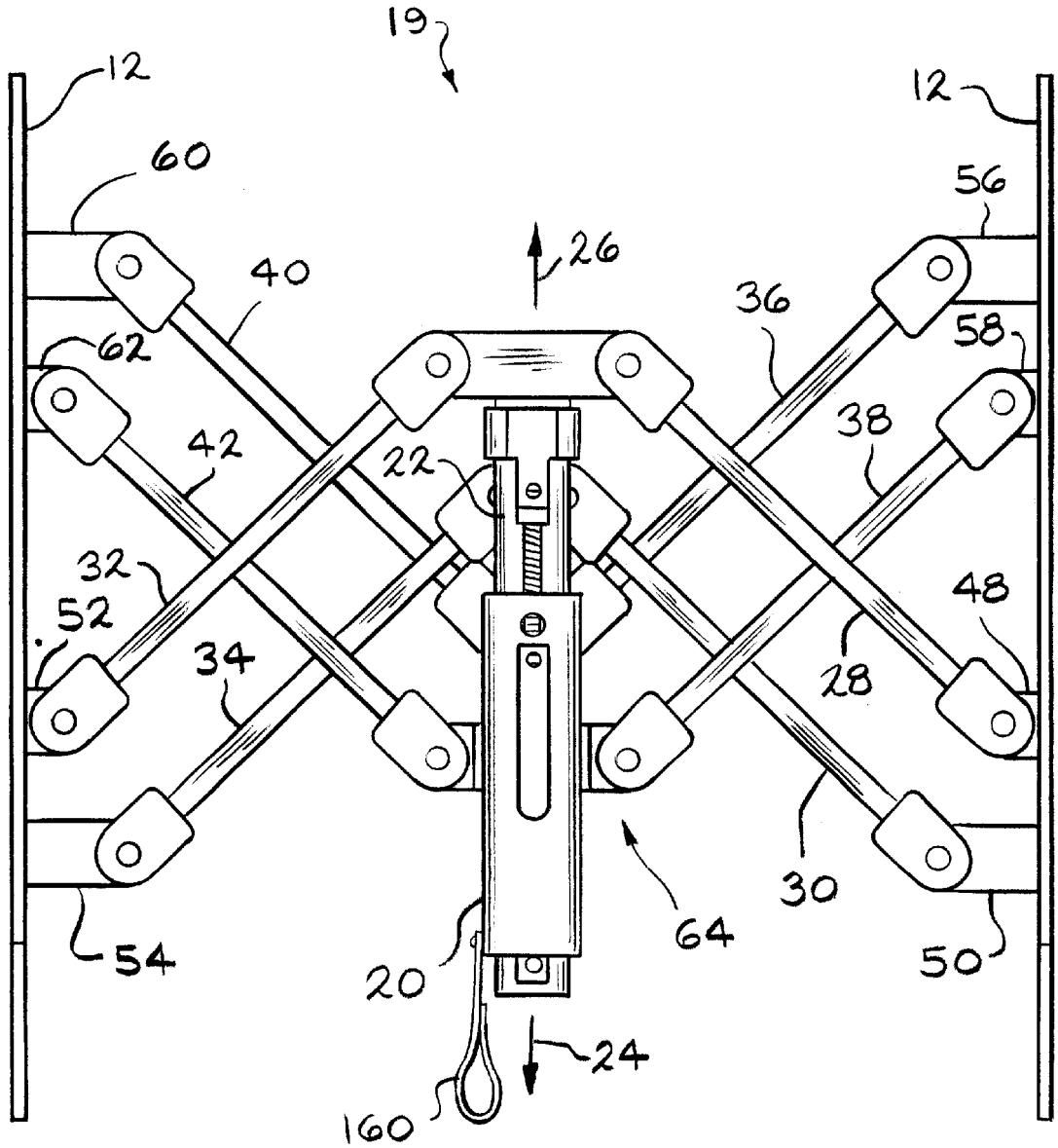
FIG. 2 is a plan view of the wheelchair frame and folding mechanism of the invention.

As shown in FIG. 2, the wheelchair frame, indicated generally at 19, includes a slider housing 20 and a slider member 22, which together define the slider assembly 23. The wheelchair frame 19 is shown in the fully open or unfolded position. The slider member 22 and the slider housing 20 are mounted for movement relative to each other, and are oriented for movement in forward and rearward directions, 24 and 26 respectively. A pair of links 28 and 30 connect the slider member 22 to the left side frame 12, and a corresponding pair of links 32 and 34 connect the slider member 22 to the right side frame 12. It can be seen that movement of the slider member 22 in the rearward direction 26 will cause the links to pivot and therefore to become more parallel to the forward-rearward orientation of the slider assembly 23. This will cause the side frames 12 to be drawn together, thereby folding the wheelchair frame 19 and the wheelchair 10.

In a similar manner to the linkage for the slider member 22, there are links for the slider housing 20. A pair of links 36 and 38 connect the slider housing 20 to the left side frame 12, and a corresponding pair of links 40 and 42 connect the slider housing 20 to the right side frame 12. It can be seen that movement of the slider member 22 relative to the slider housing 20 actuates the links to change the spacing between the first and second side frames 12, thereby opening and closing the wheelchair frame.

The links sometimes referred to as linkages, are connected to the side frames 12 by means of pivot ears. Links 28 and 30 are connected to the left side frame 12 by pivot ears 48 and 50, respectfully, which are affixed to the left side frame 12. Links 32 and 34 are connected to the right side frame 12 by pivot ears 52 and 54, respectively. In a similar manner to the connection of the links 28, 30, 32 and 34 of the slider member 22 to the side frames 12, the slider housing 20 is also connected to the side frames 12. Links 36 and 38 are connected to the left side frame 12 by pivot ears 56 and 58, respectfully, which are affixed to the left side frame 12. Links 40 and 42 are connected to the right side frame 12 by pivot ears 60 and 62, respectively. All of the pivot ears can be bolted or riveted to the side frames, or can be fixed in any other manner, such as by welding. Where the side frame 12 is molded from a composite material, the pivot ears can be molded integrally with the side frame.

The links can be of any material and shape suitable for providing the desired connection between the slider assembly 23 and the side frames 12. The links can be machined aluminum, or can be a molded composite material. The links can have an I-beam cross-sectional shape for weight reduction while maintaining high strength. The ends of the links can be provided with a yoke and clevis arrangement for connection with the pivot ears. Optionally, nylon bushings or washers can be provided between the clevis yoke and the pivot ears to reduce friction and eliminate undesirable scraping noises during operation of the folding mechanism of the wheelchair.

As shown in FIG. 2, pivot ears 48, 50, 52, 54, 56, 58, 60 and 62 are not all of equal length. At least one of the pairs of links is oriented so that the pivotal mounting at the side frame 12 leaves the one of the links in the pair being pivotally mounted at a pivot point closer to the side frame 12 than the pivot point of the other of the links in the pair. For example, pivot ear 48 is shorter than pivot ear 50, and therefore link 28 of the link pair 28 and 30 is closer to the left side frame 12. One of the advantages of the folding wheelchair frame 19 is that both the slider housing 20 and the slider member 22 are linked to a side frame 12 by two links in each direction. This configuration assures absolute parallelism between the two side frame 12 at each and every width to which the wheelchair frame 19 is extended. Further, this configuration provides a rigid, secure connection between the slider assembly 23 and the side frames 12 at each and every width to which the wheelchair frame 19 is extended. The resulting wheelchair 10 has an outstanding stability and rigidity.

Figure 3:
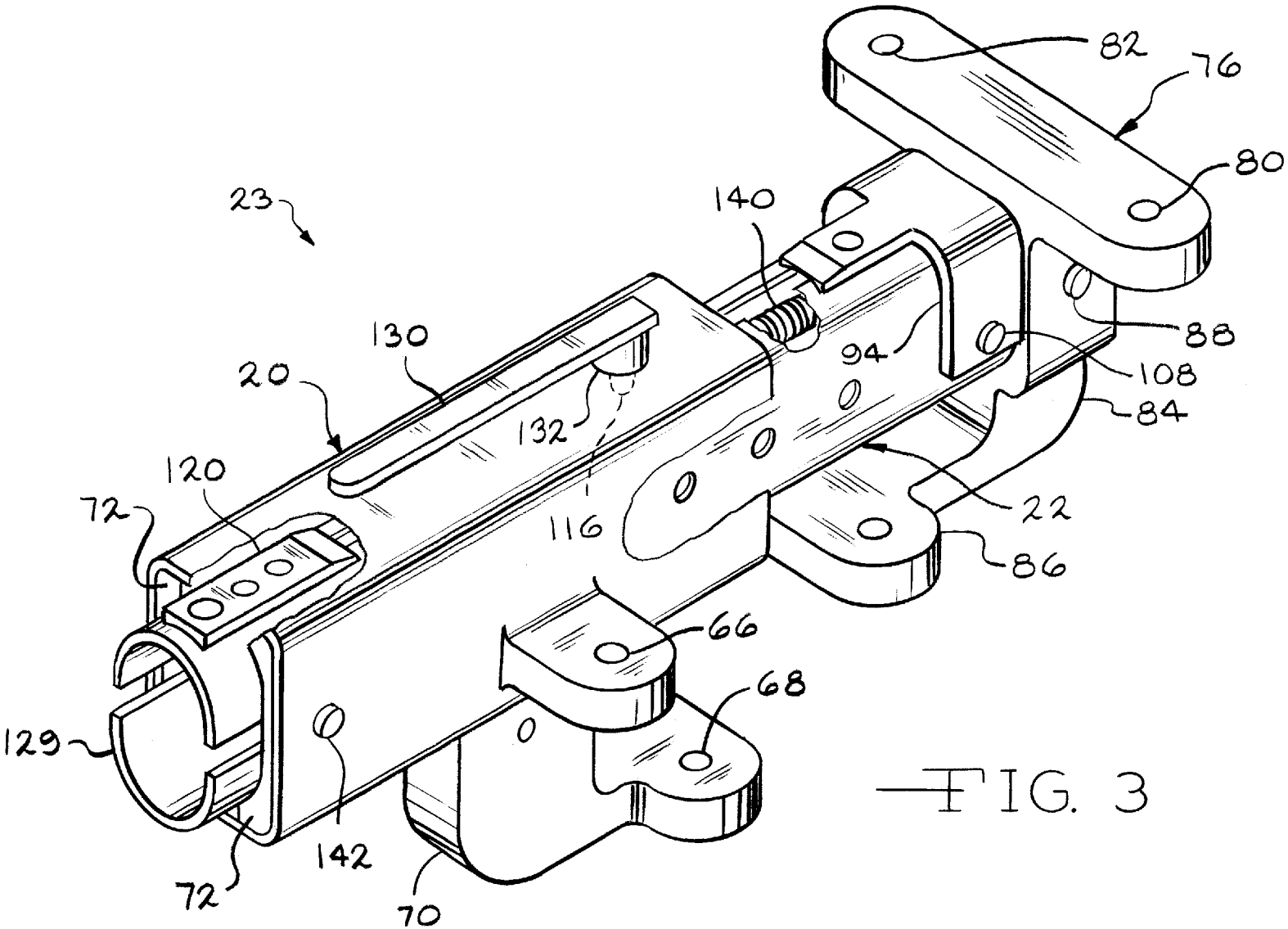
FIG. 3 is a perspective view of the housing assembly of the wheelchair frame, partially cut away to expose some of the underlying structure.
Figure 4:
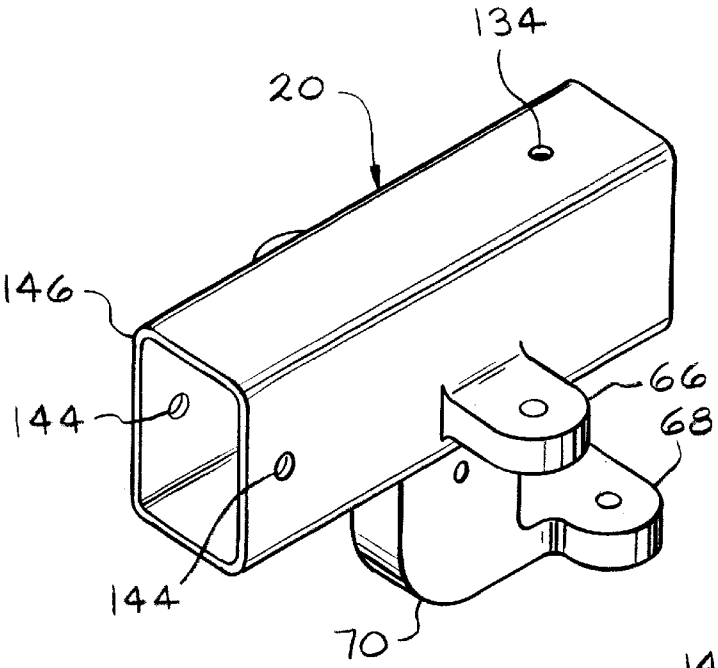
FIG. 4 is perspective view illustrating the slider housing of the invention.

As shown in FIG. 3 and 4, the slider assembly 23 is arranged so that the slider member 22 slides within the slider housing 20. The slider housing 20 is provided with upper pivot ears 66, only one of which is shown, for connection to the links 38 and 42. Lower pivot ears 68, which are attached to the slider housing 20 by means of a bracket 70, are provided for connection of the links 36 and 40 to the slider housing 20. The bracket can be integrally formed with the slider housing 20. The slider housing 20 itself is a hollow channel having a generally rectangular cross-sectional shape.

Figure 5:
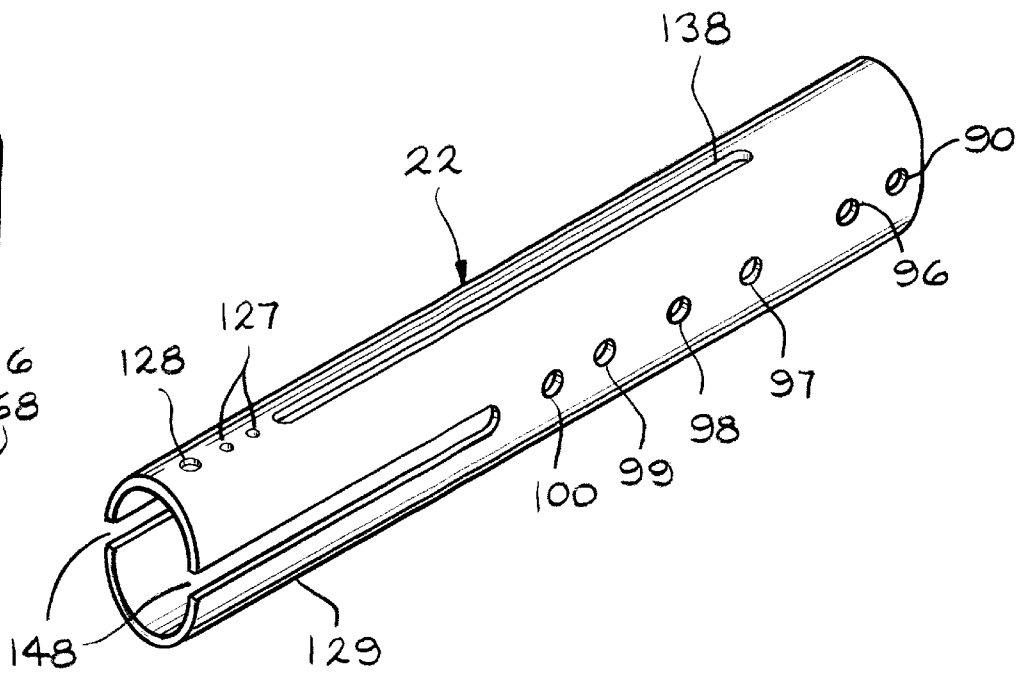
FIG. 5 is a perspective view illustrating the slider member of the invention.

The slider member 22 is generally tubular, being elongated in the forward and rearward directions, as shown in FIG. 5. The slider member 22 also has a generally oblong or rectangular cross-sectional shape. In order to facilitate the sliding of the slider member 22 within the slider housing 20, a pair of plastic bushings or guides 72 can be inserted in the slider housing 20. These guides preferably extend the whole length of the slider housing 20. The interior shape of the slider housing 20 with the bushings in place provides a generally close fit for the sliding movement of the slider member slider member 22. The generally rectangular cross-sectional shape of the slider member 22 and of the interior of the slider housing 20 prevents the slider member 22 from twisting or rotating with respect to the orientation of the slider housing 20.

Figure 6:
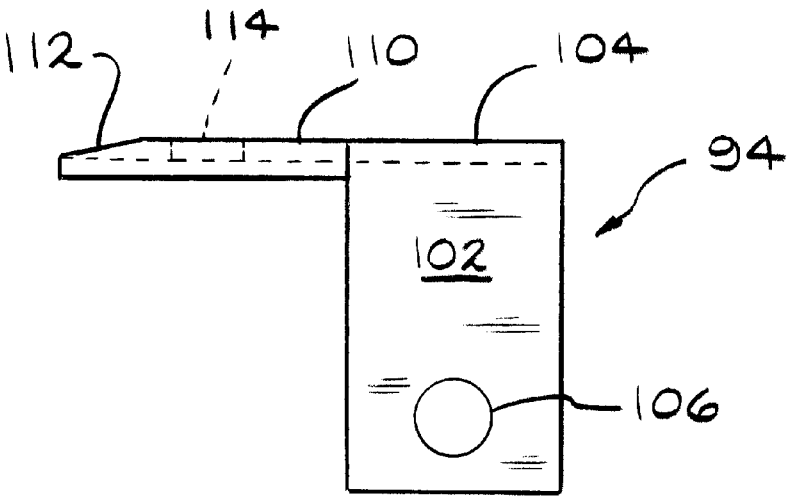
FIG. 6 is an elevational view of the rearward latch member of the invention.
Figure 7:
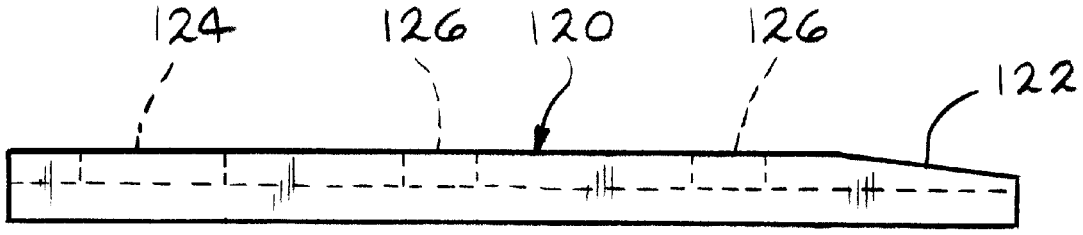
FIG. 7 is an elevational view of the forward latch member of the invention.

As shown in FIGS. 3, 6 and 7 there are three attachments to the slider member 22. The first attachment is a rear bracket, indicated generally at 76, that includes a rear pivot strip 78 having pivot ears 80 and 82 for connection of the links 28 and 32, respectfully to the slider member 22. The rear bracket 76 also includes a downwardly hanging bracket 84 provided with two pivot ears 86, only one of which is shown. The two pivot ears 86 connect the links 30 and 34 to the slider member 22. The sides of the rear bracket are provided with side orifices, not shown, and the rear bracket 76 is attached to the slider member 22 by means of a fastener, such as a pin 88 that is inserted through corresponding rear bracket orifices 90 at the rearward end of the slider member 22, shown in FIG. 5.

The second attachment to the slider member 22 is an adjustment stop block 94, as shown in FIGS. 3 and 6. The adjustment stop block is mounted on the slider member 22 by means of any one of five pairs of adjustment orifices 96–100. The adjustment stop block 94 includes side panels 102 flanking the sides of the slider member 22, and a top connector panel 104. The side panels 102 are provided with holes 106 for attachment of the adjustment stop block 94 to the slider member 22. A pin 108, shown in FIG. 3, is inserted through the stop block holes 106 and through one of the five adjustment orifices 96–100 in the slider member 22 to attach the adjustment stop block 94 to the slider member 22. It is to be understood that more or less than five orifices can be used. The adjustment stop block also includes a latch member 110 in the form of a striker plate that extends forward from the top connector panel 104 along the top of the slider member 22. The latch member 110 is provided with a beveled forward end 112, and a latch orifice 114. The beveled forward end 112 of the latch member 110 eases the progress of a latch pin 116 onto the latch member 110 and into the latch orifice 114 as the slider member 22 advances forward with respect to the slider housing 20. It can be seen that the seating of the latch pin 116 into the latch orifice 114 acts as a stop to the forward movement of the slider member 22 with respect to the slider housing 20. In view of the fact that the linkage arrangement between the slider assembly 23 and the side frames 12 controls the unfolding or opening of the wheelchair frame 19, the maximum extent of the forward movement of the slider member 22 with respect to the slider housing 20 determines the maximum extent of the unfolding of the wheelchair frame. Therefore, location of the latch orifice necessarily determines the maximum width of the wheelchair frame.

It can be seen that the position of the latch orifice 114 with respect to the slider member 22 can be adjusted to any one of five different predetermined locations on the slider member 22 by connecting the adjustment stop block 94 to the slider member 22 in any one of the five different adjustment orifices 96–100, which are at five different predetermined locations on the slider member 22. Each position sets the latch orifice 110 in a different predetermined position with respect to the slider member 22. Therefore, the width of the wheelchair frame in the opened position can be set at any one of five different values. In a preferred embodiment of the invention, the predetermined locations of the orifices 96–100 on the slider member are spaced apart in an arrangement that corresponds with widths of the wheelchair frame that are approximately one inch apart from a next adjacent width. For example, attaching the adjustment stop block 94 to the slider member 22 using the rearmost adjustment orifice 96 could correspond to a fully opened wheelchair frame 19 having a width of 18 inches. The next adjustment orifice, orifice 97, could correspond to a wheelchair frame width of 17 inches, and the remaining orifices 98, 99 and 100, could correspond to widths of 16, 15 and 14 inches, respectively. In such an arrangement, the wheelchair frame can be easily adjusted to a desired maximum open width by mounting the adjustment stop block 94 at the appropriate adjustment orifice 96–100. It can be seen that structural configuration of the folding wheelchair frame 19 enables the width of the wheelchair to be modified by means of a simple adjustment, without requiring additional equipment or structural elements.

Figure 8:
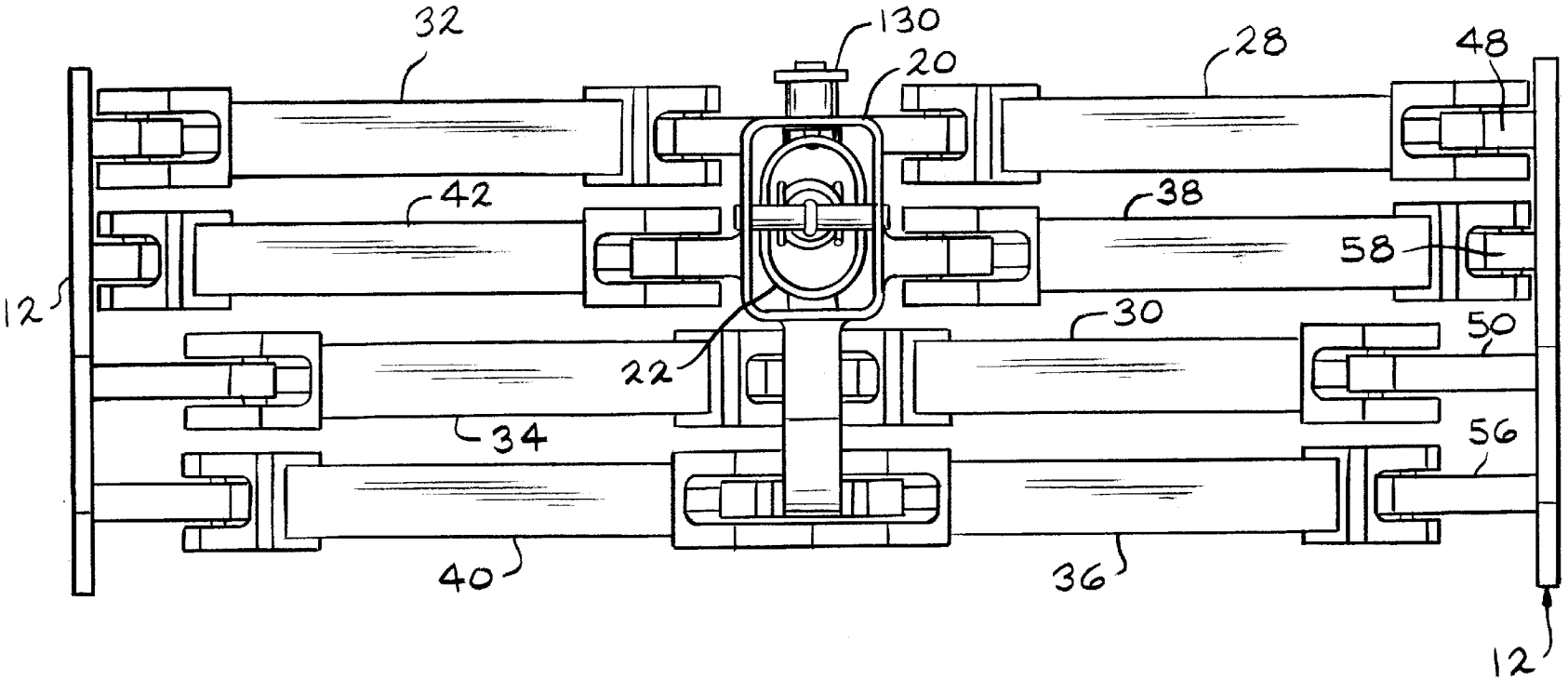
FIG. 8 is a front end view in elevation showing the wheelchair frame and folding mechanism in an open position.
Figure 9:
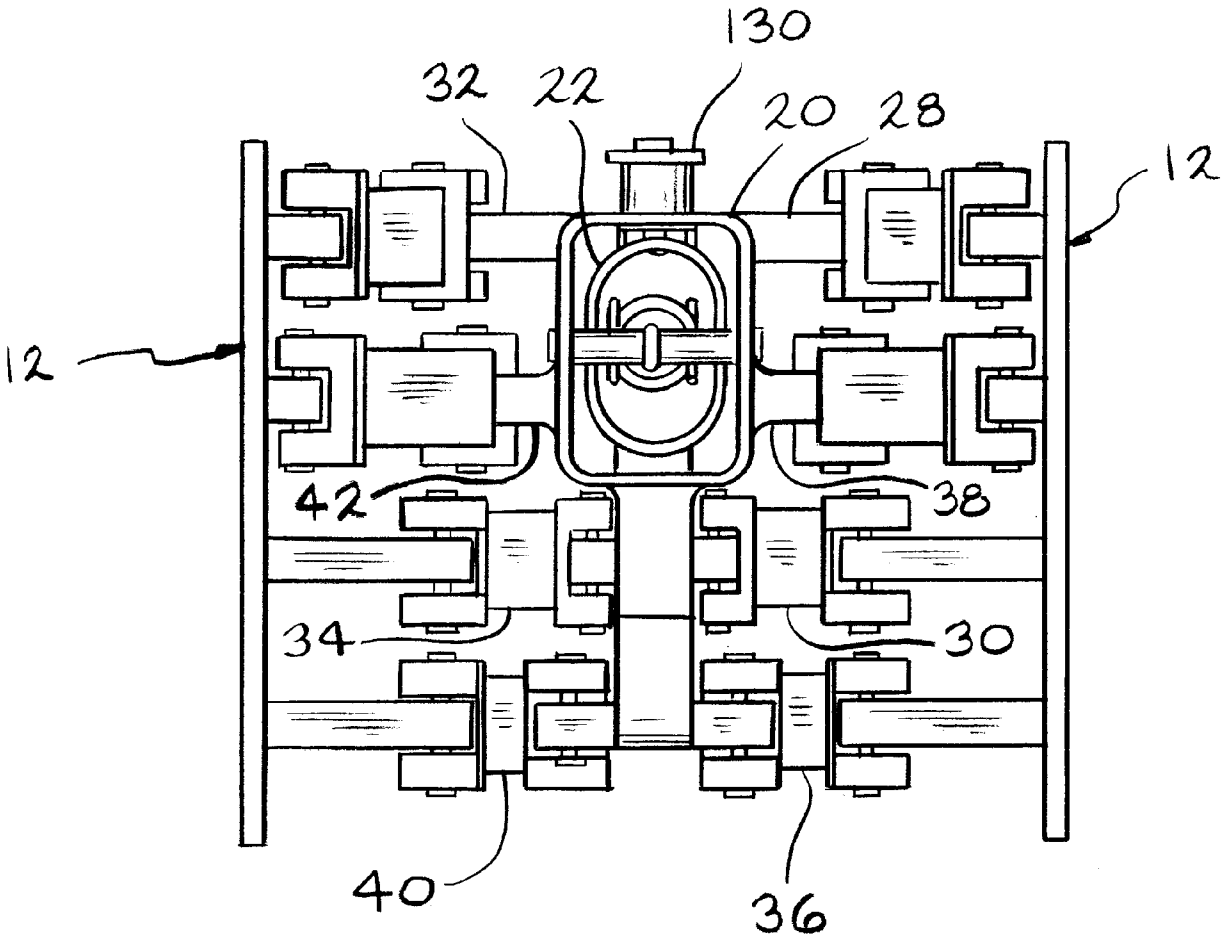
FIG. 9 is a front end view in elevation showing the wheelchair frame and folding mechanism in a closed position.

The third attachment for the slider member 22 is the closing stop block 120 as shown in FIGS. 3 and 7. The closing stop block 120 includes a beveled rearward end 122 and a closing latch orifice 124 for receiving the latch pin 116. The closing stop block can be attached to the slider member 122 by any suitable means, such as set screws, not shown, positioned in screw orifices 126 in the closing stop block 120, and in screw orifices 127 in the slider housing 20. An aperture 128 in the forward end 129 of the slider member 22 is aligned with the closing latch orifice 124 in the closing stop block 120. In operation, the rearward movement of the slider member 22 with respect to the slider housing 20 causes the closing stop block 120 to move rearwardly with respect to the latch pin 116, and the latch pin engages the closing latch orifice 124. This acts as a limit to the travel of the rearward movement of the slider member 22 with respect to the slider housing 20, and therefore the engagement of the latch pin 116 with the closing latch orifice 124 sets the minimum width of the wheelchair frame 19 in the folded position. It can be seen that the stop, in the form of the latch pin 116, engages the latch orifice 110 and the closing latch orifice 124, which can be viewed as first and second orifices, at either end of the travel of the slider member slider member 22, thereby establishing the maximum and minimum extent of relative movement, respectively, of the slider member with respect to the slider housing. The minimum or folded width of the wheelchair frame 19 is shown in FIG. 9, and the maximum or fully opened width of the wheelchair frame 19 is shown in FIG. 8. It can be seen that the height and width of the wheelchair frame 19 is extremely small in comparison with the dimensions of the other portions of the wheelchair, such as the side frames 12 and the rear drive wheels 14. Preferably, the folded wheelchair frame 19 has a height that is within the range of from about 0.15 to about 0.25 times the diameter of the rear drive wheel, and a width that is within the range of from about 0.15 to about 0.25 times the diameter of the rear drive wheel.

As shown in FIG. 3, the latch pin 116 is mounted at the end of latch lever 130, which is in turn attached to the slider housing 20 by means of a lever mount 132, mounted to the slider housing 20 using orifice 134 (FIG. 4). The lever mount 132 is preferably somewhat flexible to act as a fulcrum so that downward movement of the latch lever 130 raises the latch pin upward, away from the slider member 22. The length of the latch pin 116 is such that it is normally biased downwardly onto the top surface of the slider member 22. Raising the latch pin 116 upward by pressing on the latch lever releases the latch pin from engagement with the latch orifice 114 or the closing latch orifice 124, thereby freeing the slider member 22 to slide relative to the slider housing 20. A latch pin aperture 136 is provided in the slider housing 20 to allow the latch pin to contact the slider member 22. The top of the slider member 22 is preferably provided with a longitudinal slot 138 enable the latch pin 116 to slide easily from the closed frame position, with the latch pin 116 in engaged in the closing latch orifice, to the open frame position, with the latch pin engaged in the latch orifice 110.

The material used in fabricating the slider housing 20 and slider member 22 is preferably either a composite material or an aluminum material. When aluminum is used for the slider member 22, some of the related parts, such as the adjustment stop block 94 and the closing stop block 120, are preferably made of steel to reduce wear on the contact surfaces.

One of the advantageous features of the folding mechanism of the invention is the use of a spring 140 to act as an assist in opening the wheelchair frame 19. The spring is contained within the slider member 22 and slider housing 20, and is arranged to bias the slider member 22 and slider housing 20 toward each other, thereby opening the wheelchair frame 19. The rearward end of the spring can be attached to the slider member 22 in any suitable manner, such as by attaching the spring to the pin 108 that is used to attach the adjustment stop block 94 to the slider member 22. The other end of the spring 140 can be attached to a pin 142 that is inserted into opposed orifices 144 in the forward end 146 of the slider housing 20. In order to accommodate the sliding of the forward end 129 of the slider member 22 past the pin 142, the forward end 129 of the slider member 22 is provided with a pair of clearance slots 148. Other types of biasing members besides springs can be used to bias the slider member 22 and slider housing 20 toward each other. Although the spring 140 is illustrated as being positioned within the slider member 22 and the slider housing 20, it is to be understood that the biasing member or spring can be positioned outside the slider member 22 and the slider housing 20. No matter where the spring 140 is positioned, the spring should have enough strength to pop open or at least assist the wheelchair user in opening the wheelchair 10 from the folded position to the unfolded position when the latch pin 116 is released from the closing latch orifice 124. Therefore, the wheelchair can be opened by merely pressing on the latch lever 130.

In one aspect of the invention either the slider housing 20 or the slider member slider member 22, or both, can be viewed generically as a slider that is positioned between the two side frames 12, with the slider being mounted for movement in the forward and rearward directions 24, 26 with respect to the side frames. The links connecting the slider to both the side frames operate in a manner in which movement of the slider relative to the side frames 12 changes the spacing between the side frames, thereby opening and closing the wheelchair frame. As shown in FIG. 3 the spring 140 biases the slider member 22 toward the slider housing 20. However, the spring or other biasing member can be configured to connect, using a cross strut, not shown, the slider to one or both of the side frames. In such a case, the biasing member could be arranged to bias the slider in a direction to open the wheelchair frame.

Another embodiment of the invention hinges on the fact that there are eight links connecting the slider (i.e., either the slider housing 20 or the slider member 22 or both) to both the side frames so that movement of the slider relative to the side frames changes the spacing between the side frames. Four of the links are positioned in four different horizontal planes on the right side of the wheelchair, and the other four of the links being mounted in four different horizontal planes on the left side of the wheelchair, as shown in FIG. 9. This has the benefit that the links will not interfere with each other during the folding of the wheelchair frame.

In yet another aspect of the invention, the slider assembly 23 can be provided with a pull strap 160 connected to the slider housing 20, as shown in FIG. 2. When the wheelchair 10 is to be folded, the operator or wheelchair user braces or holds a side frame 12 with one hand and pulls the strap 160 forward with the other hand, thereby pulling the slider housing 20 forward with respect to the side frame 12, and causing the wheelchair frame 19 to be folded. This action is against the bias of the spring 140. In an alternative arrangement, not shown, the strap 160 can be attached to the rear end of the slider member 22, and the wheelchair frame 19 can be folded by pulling the slider member 22 rearward with respect to the side frame 12. In yet another embodiment of the invention, the slider housing 20 can be provided with a handle, not shown, which can be mounted on the housing itself, or on the latch lever 130. Regardless of how the strap or handle is attached, the wheelchair frame 19 can be folded by rotating the entire wheelchair backwards ninety degrees and lifting up on the strap or handle as if to suspend the wheelchair by the strap or handle. The weight of the wheelchair will cause the remainder of the wheelchair to fall with respect to the slider member 22, thereby folding the wheelchair frame 19 to the closed position. An alternative method of folding the wheelchair is to push the two side frames 12 together.

Figure 10:
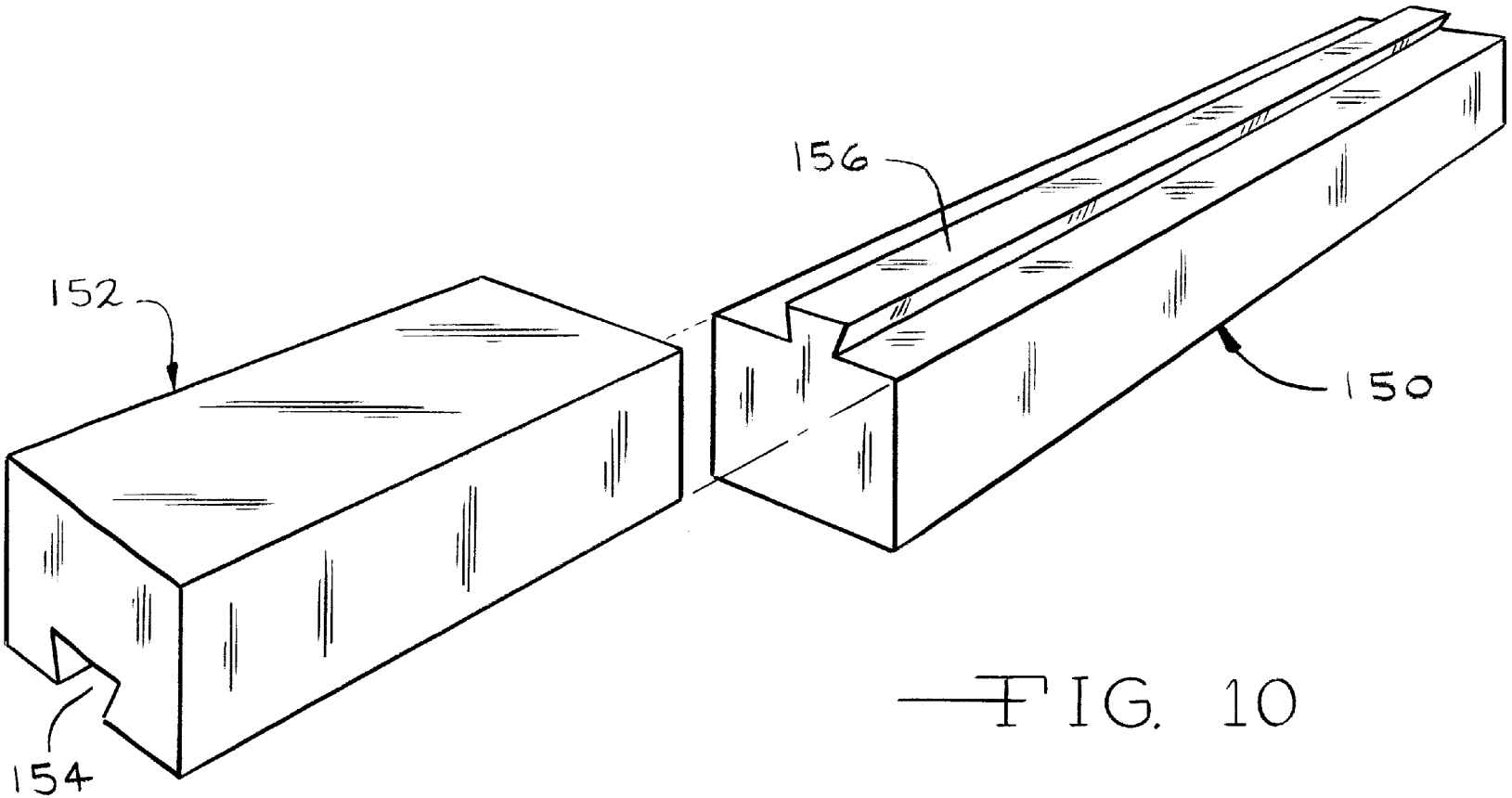
FIG. 10 is a perspective view of an alternate embodiment of the slider housing and slider member of the invention.

It is to be understood that the slider assembly 23 need not be formed from a slider member 22 that slides within a slider housing 20. In an alternate embodiment shown in FIG. 10 a block-shaped slider member 150 is adapted to slide relative to a block-shaped slider housing 152. The slider housing 152 has a longitudinal keyway 154 that receives an elongated key 156. The slider member 150 and slider housing 152 can be provided with pivot ears, not shown, for connecting links similar to those described above.

Figure 11:
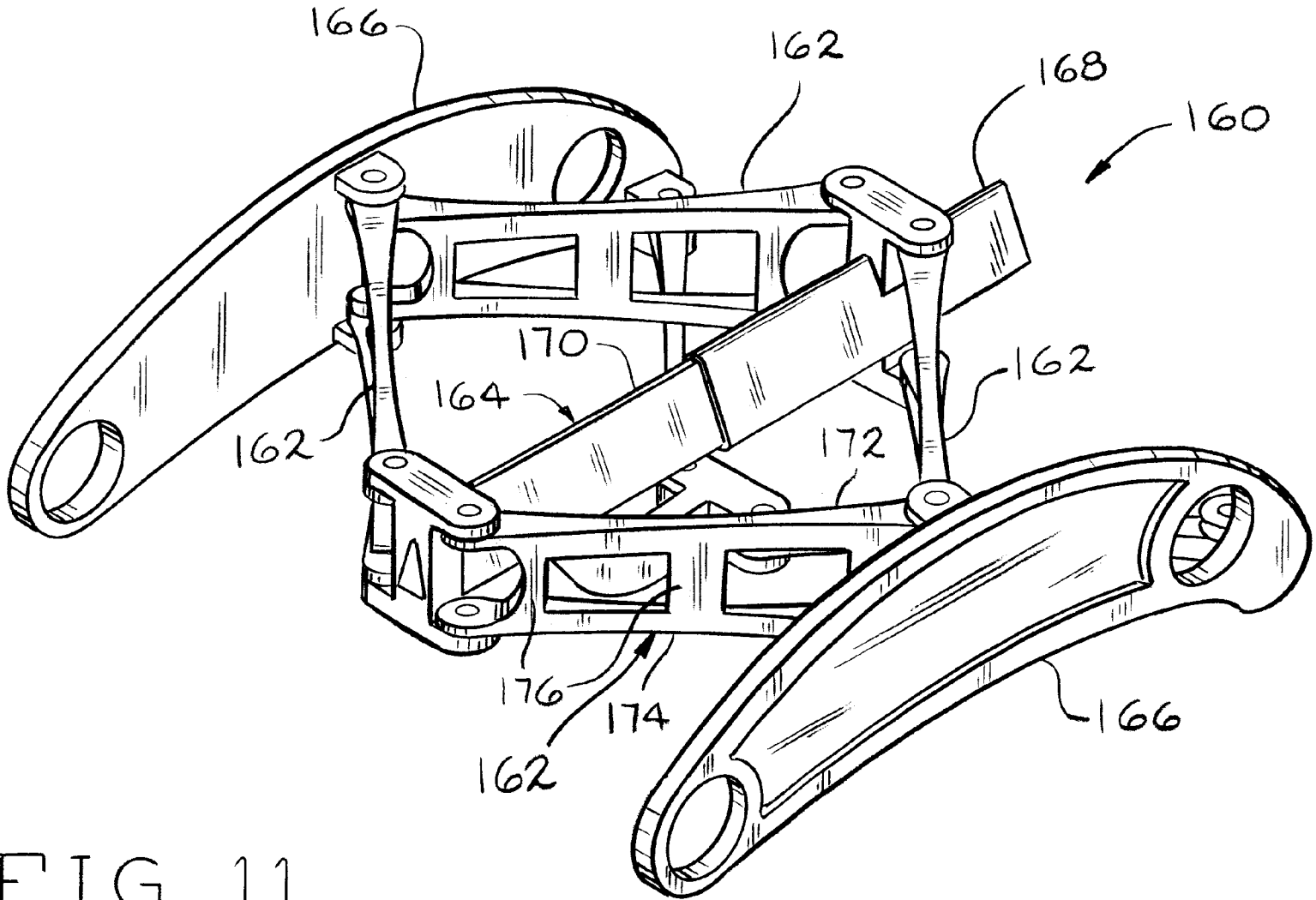
FIG. 11 is a perspective view of an alternate embodiment of the folding mechanism of the invention.
Figure 12:
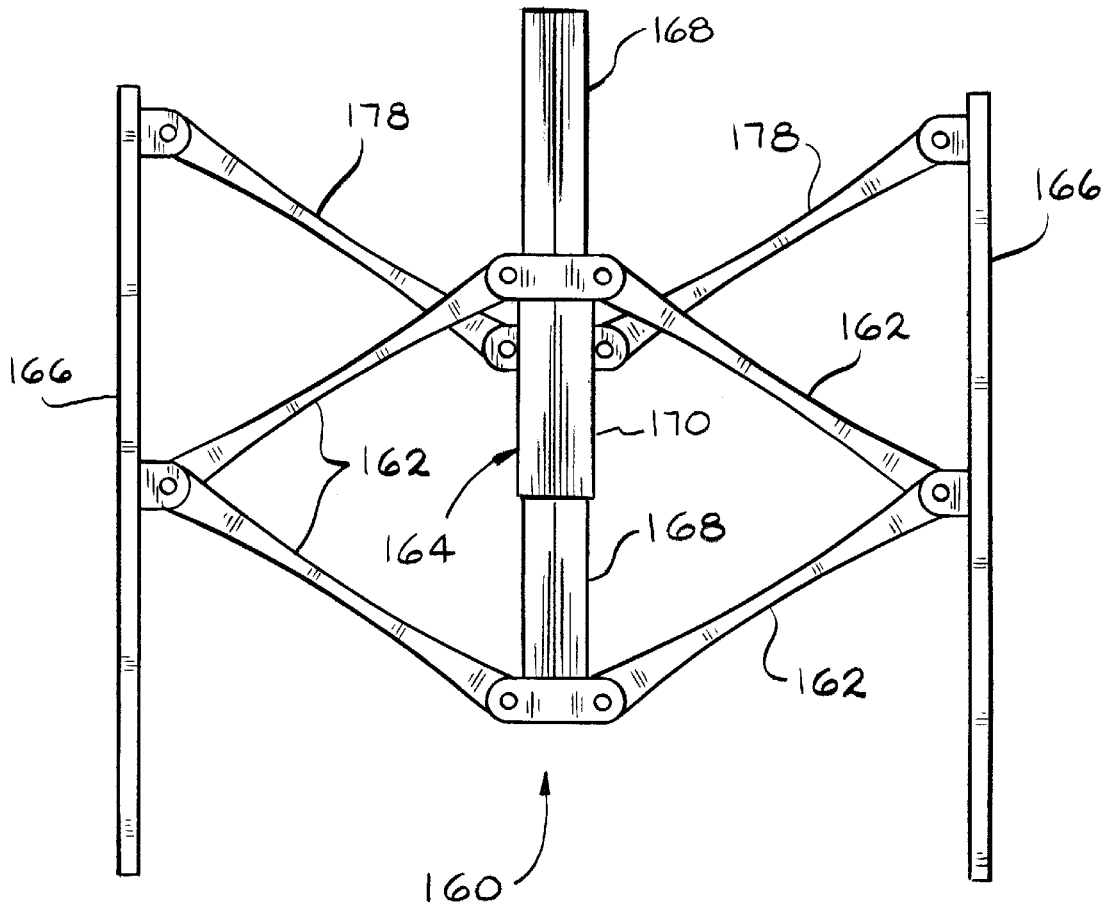
FIG. 12 is a plan view of the folding mechanism of FIG. 11.

As shown in FIGS. 11 and 12, an alternate embodiment of the invention includes a wheelchair frame 160 in which the links are in the form of panels 162 that connect the slider assembly 164 to the side frames 166. The slider assembly 164 is comprised of a slider member 168 which is mounted to slide into a slider housing 170. Each of the panels is connected with a pivotal connection at the side frames 166 and a pivotal connection at either the slider member 168 or the slider housing 170. Two of the panels connect the slider housing 170 to the side frames 166, and two of the panels connect the slider member 168 to the side frames 166. The panels 162 can be of any suitable construction. Preferably they include top beams 172, bottom beams 174 and gussets 176, as shown. Optionally, an additional pair of links 178, as most clearly shown in FIG. 12, is included to provide an additional pivot connection between the slider housing 170 and the side frames 166. Although the cross-sectional shape of the slider member 168 and slider housing 170 can be any suitable shape, it is preferred to have a non-circular cross-sectional for these parts so that there can be no undesirable rotation or twisting of these two parts with respect to each other. As shown, the cross-sectional shape of the slider housing and slider member is generally triangular. This provides an element of stability to the sliding connection between the slider housing and the slider member. As disclosed above, other cross-sectional shapes, such as a square shape, can be used.

Figure 13:
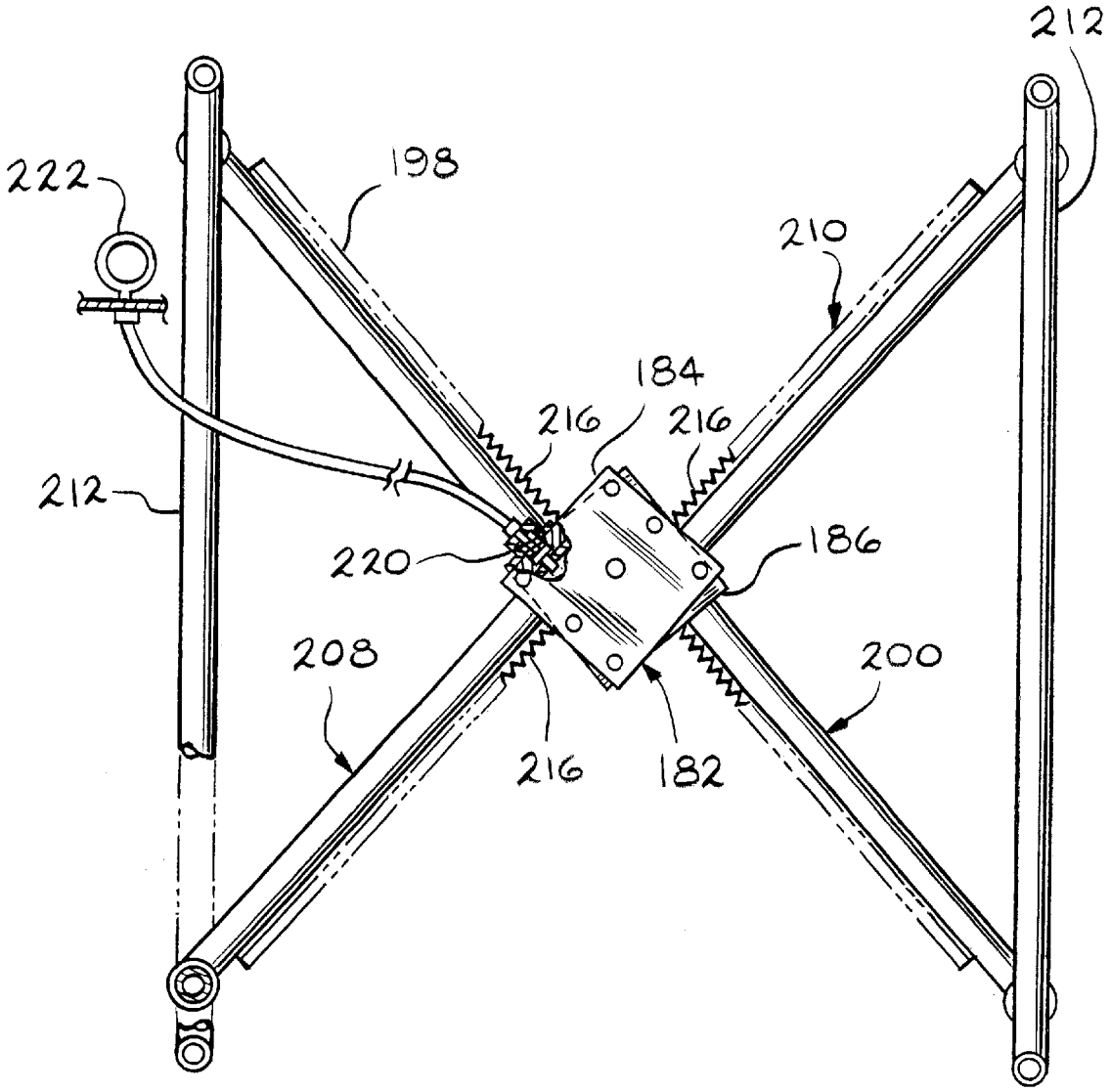
FIG. 13 is a plan view of the folding mechanism of yet another alternate embodiment of the invention, using a rack and pinion and a coil spring.
Figure 14:
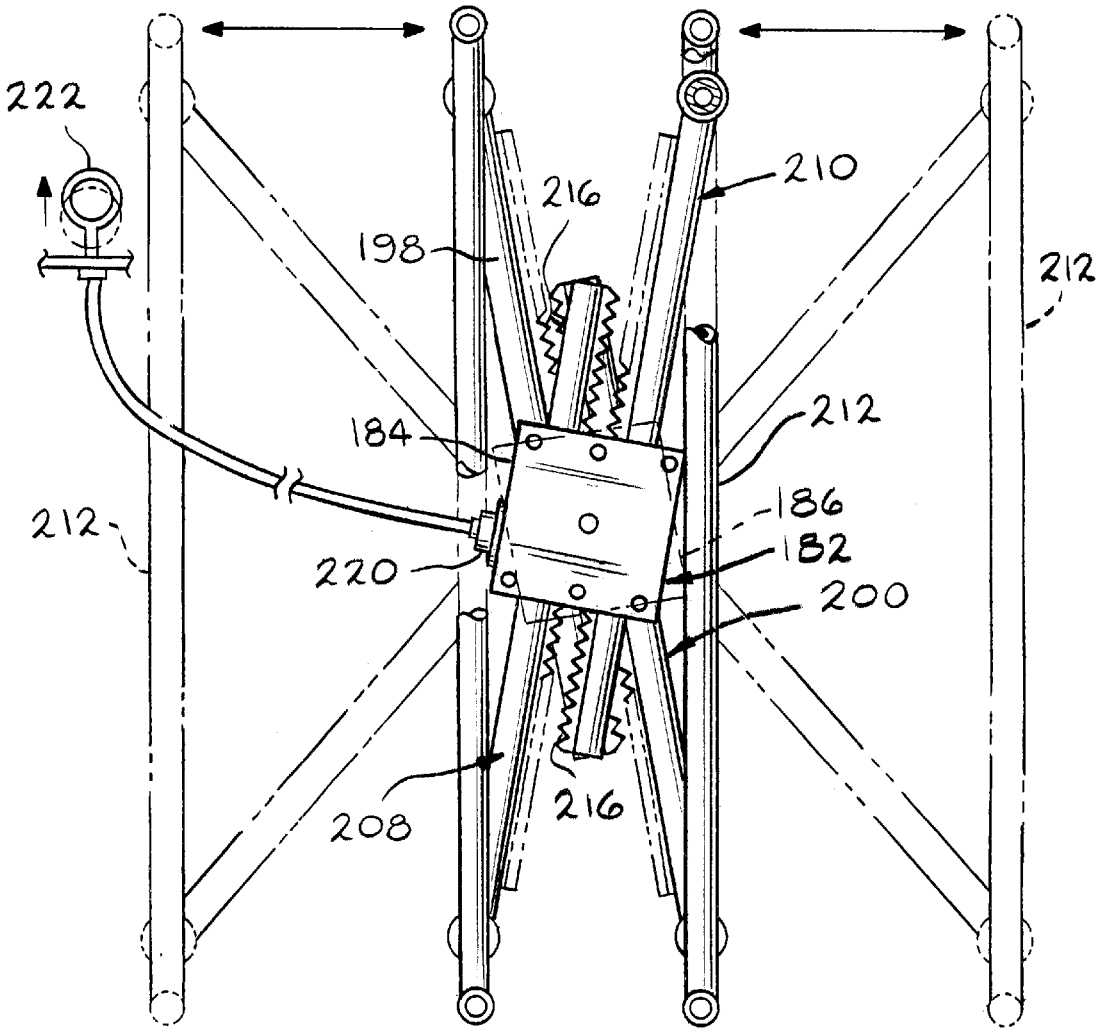
FIG. 14 is a plan view of the folding mechanism of FIG. 13, showing the folding mechanism in a closed position.
Figure 15:
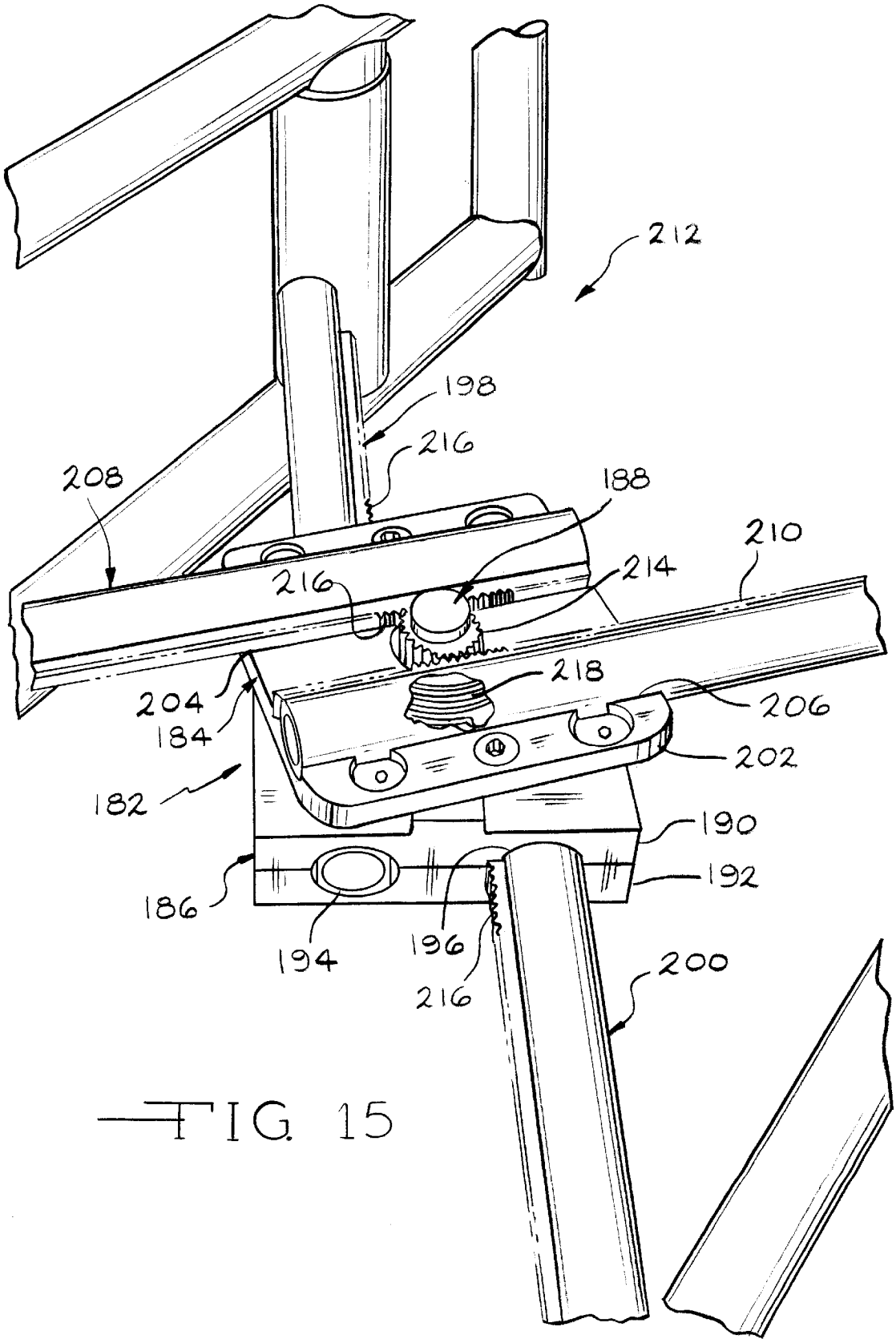
FIG. 15 is a perspective view of the folding mechanism of FIG. 13.

FIG. 13–15 illustrate a folding mechanism of the invention using a rack and pinion arrangement. The center block assembly 182 is comprised of an upper block 184 and a lower block 186, with the two blocks being pivotally tied together for rotation relative to each other on a vertical pivot pin 188. The lower block 186 is made of mating top and bottom halves 190, 192 that define slip channels 194, 196. The slip channels 194, 196 are adapted to slidingly receive horizontal elongated elements 198, 200, respectively. In a similar manner, the upper block 184 is made of mating top and bottom halves, but for purposes of clarity only the bottom half 202 is shown in FIG. 15. The top half and the bottom half 202 together define slip channels 204 and 206, respectively. The slip channels 204 and 206 are adapted to slidingly receive horizontal elongated elements 208, 210, respectively.

The elongated elements 198, 200, 208 and 210 are pivotally connected at their distal ends to the wheelchair side frames 212. As shown in FIG. 14, as the wheelchair is folded and the side frames are brought together, the elongated elements slide relative to the center block assembly 182 to shorten the distance between the center block assembly and the side frames 212. The pivot pin 188 of the center block assembly functions as a central gear and includes a plurality of teeth 214 so that the pivot pin 188 can act as a pinion of a rack and pinion arrangement. The elongated elements 208 and 210 are provided with racks 216 that mesh with the teeth 214 of the pivot pin 188 as the elongated elements slide through the slip channels of the upper block 184. There is also gearing, not shown, in the lower block 186 that meshes with the racks 216 on the elements 198 and 200.

The pivot pin 188 is also provided with a spring, such as the coil or helical spring 218 that is configured to resist inward movement of the elongated elements 198, 200, 208 and 210. A torsion spring, not shown, made of an elastomeric material can also be used. When the wheelchair is folded, the inward movement of the elongated elements 198, 200, 208 and 210 causes the central gear, i.e., the pivot pin 188, to rotate and wind up the coil spring 218. This also causes the upper block 184 and lower block 186 to rotate relative to each other about the pivot pin 188. This rotation creates potential energy in the spring 218 and biases the upper block 184 with respect to the lower block 186. Therefore, movement of the upper and lower blocks during folding creates a biasing force that urges the wheelchair to an open position. This feature greatly improves the utility of the wheelchair because there is a mechanism to assist the wheelchair operator or user in unfolding the wheelchair.

An optional feature of the wheelchair shown in FIGS. 13–15 is a latch mechanism 220, which locks the wheelchair in a folded or closed position. The latch can be any type of latch, such as a spring loaded pin, not shown. Preferably, a remote latch release 222 is provided to enable remote actuation of the pin to release the latch 220 and allow the wheelchair to pop open when desired by the wheelchair user.

Figure 16:
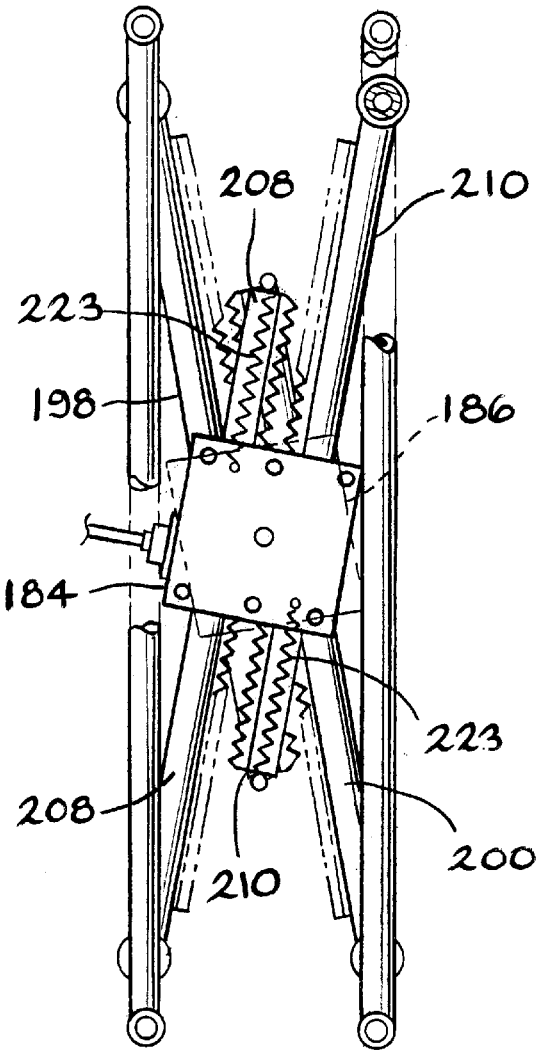
FIG. 16 is a partial view similar to that shown in FIG. 14, illustrating the use of extension springs.
Figure 17:
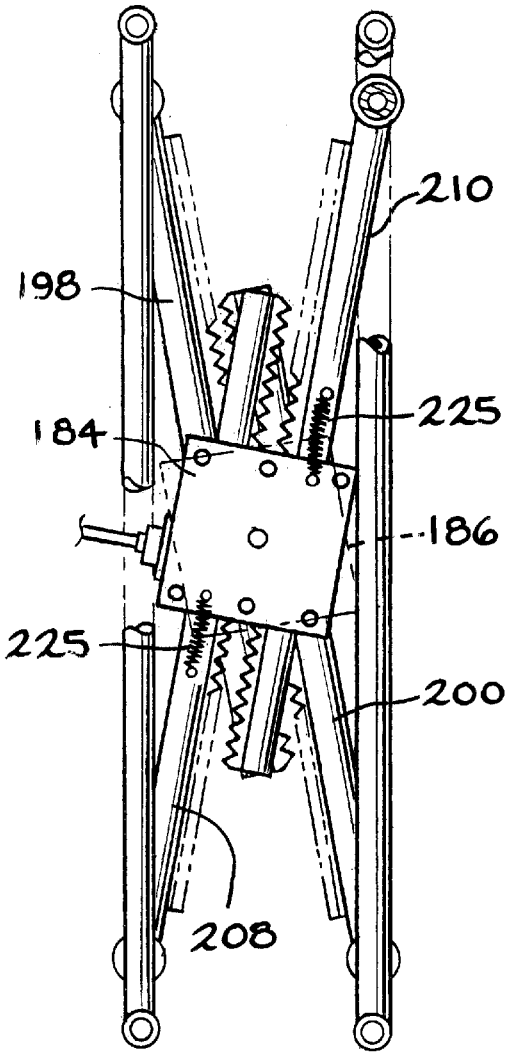
FIG. 17 is a partial view similar to that shown in FIG. 14, illustrating the use of compression springs.

As shown in FIG. 16, in a modification of the embodiment shown in FIGS. 115, extension springs 223, only two of which are shown, can be connected between the elongated elements (198, 200, 208 and 210) and the upper and lower blocks 184, 186. Movement of the elongated elements relative to the blocks 184, 186 stretches the springs 223 and generates a biasing force. Likewise, as shown in FIG. 17, compression springs 225, only two of which are shown, can be connected between the elongated elements (198, 200, 208 and 210) and the upper and lower blocks 184, 186. Movement of the elongated elements relative to the blocks 184, 186 compresses the springs 225 and generates a biasing force. The extension springs 223 and the compression springs 225 could also be in the form of a compressible material, such as an elastomer.

Figure 18:
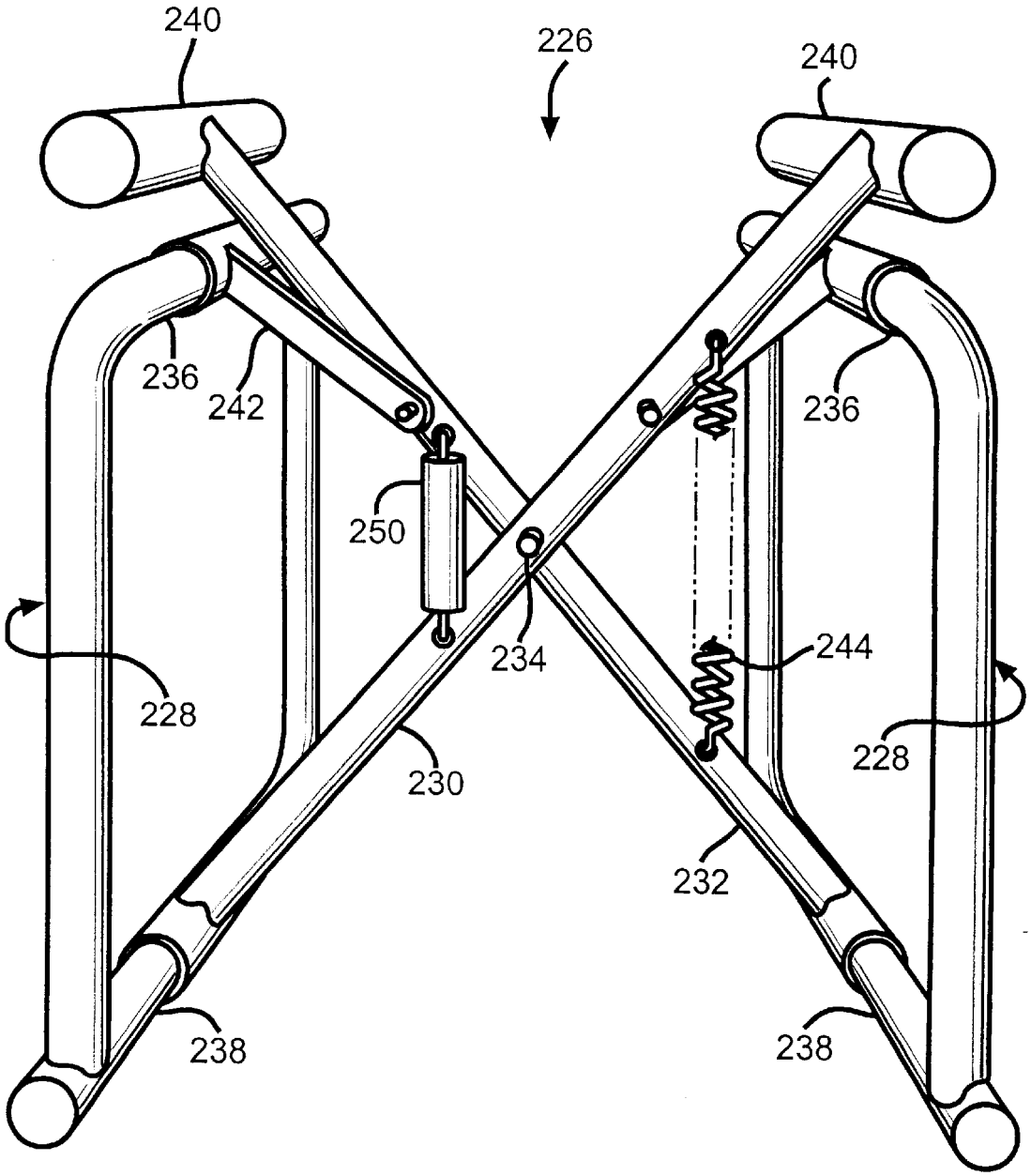
FIG. 18 is a perspective view of another folding mechanism, using a tension spring, according to the invention.

As shown in FIG. 18, the wheelchair frame 226 can be comprised of opposed side frames 228 and cross braces 230, 232 that are connected at a pivot pin 234. Although only two cross braces 230, 232 are shown, a second set of cross braces, not shown, could be used. The cross braces 230, 232 are mounted for movement in a vertical plane, and the pivot pin is horizontal. Each of the side frames 228 is comprised of upper and lower side frames, such as tubes 236, 238, respectively. At their top ends the cross braces 230, 232 are connected to seat rails 240. Links 242 are connected at one end to the upper side frames 238 and connected with a pivotal connection at the other ends to the cross braces 230, 232.

A tension spring 244 is connected to each of the cross braces 230, 232 so that when the wheelchair frame 226 is folded toward a closed position, the extension of the tension spring 244 will bias the wheelchair frame toward the open position. In this manner, the bias of the spring will assist the wheelchair user in opening the wheelchair. It can be seen that the first and second frame members, i.e., cross braces 230, 232, are movable relative to each other over a range of relative motion during the folding and unfolding of the wheelchair. This range of motion is dictated by the geometry and physical structure of the wheelchair frame 226. The length of the spring 244 can be chosen, and the mounting position on the cross braces can be selected, so that the spring is unextended or unbiased when the wheelchair is completely open, but where the spring becomes extended after the wheelchair frame is folded through a portion of the range of relative motion. In this situation the biasing member would be adapted to exert the biasing force urging the wheelchair to an open position throughout a portion of total range of relative motion. Preferably, the spring is configured so that it is extended to create a biasing force over at least a majority of the range of relative motion of the first and second frame members. It is to be understood that the spring 244 can be adapted to exert the biasing force urging the wheelchair to an open position throughout the entire range of relative motion of the first and second frame members, i.e., the cross braces 230, 232.

Figure 19:
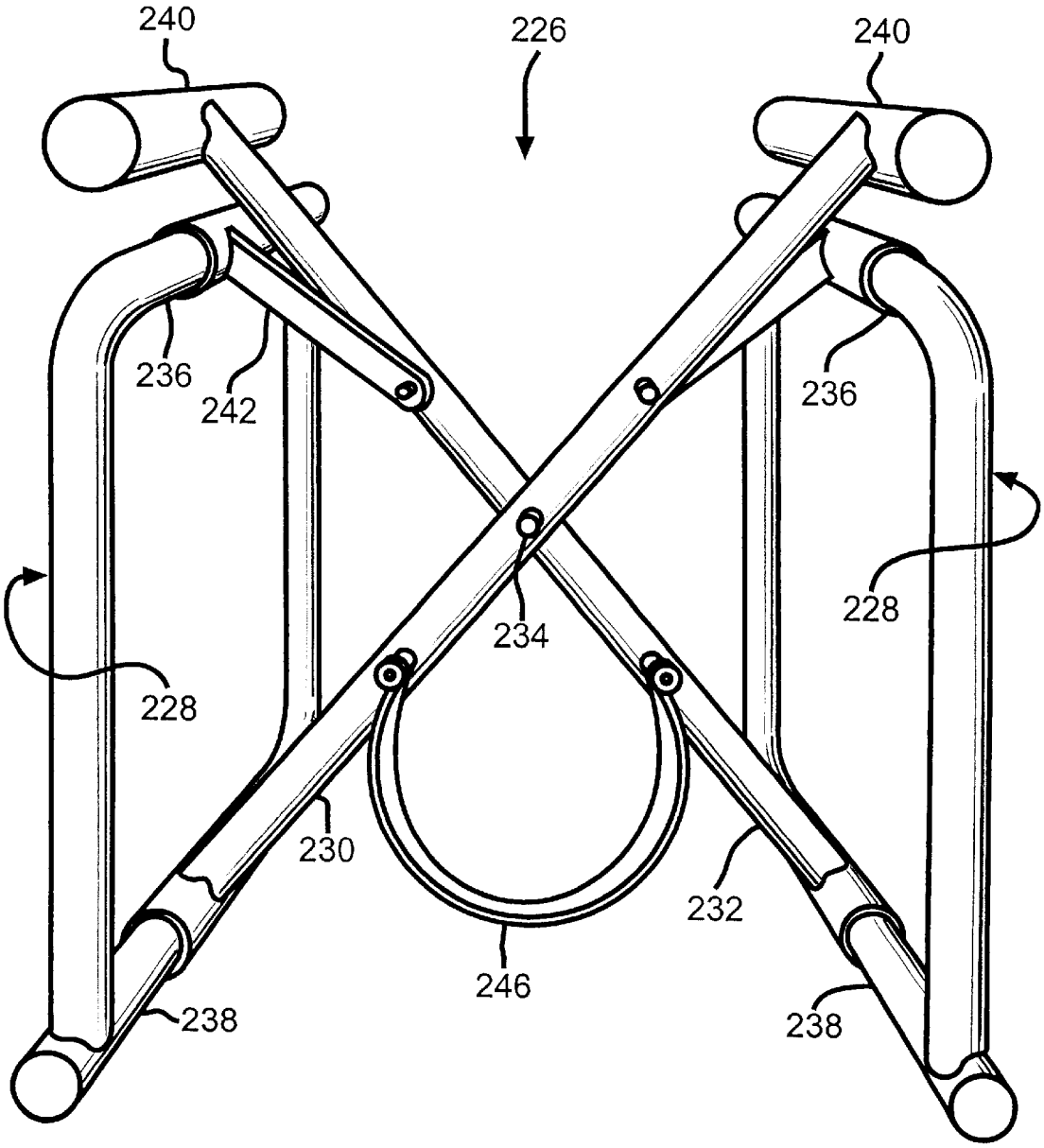
FIG. 19 is a perspective view of another folding mechanism, using a leaf spring, according to the invention.

The embodiment shown in FIG. 19 is similar in every manner to that shown in FIG. 18 except that the biasing member is a leaf spring 246. When the wheelchair frame 226 is folded toward a closed position, the extension of the leaf spring 246 will bias the wheelchair frame toward the open position. In this manner, the bias of the leaf spring will assist the wheelchair user in opening the wheelchair.

Figure 20:
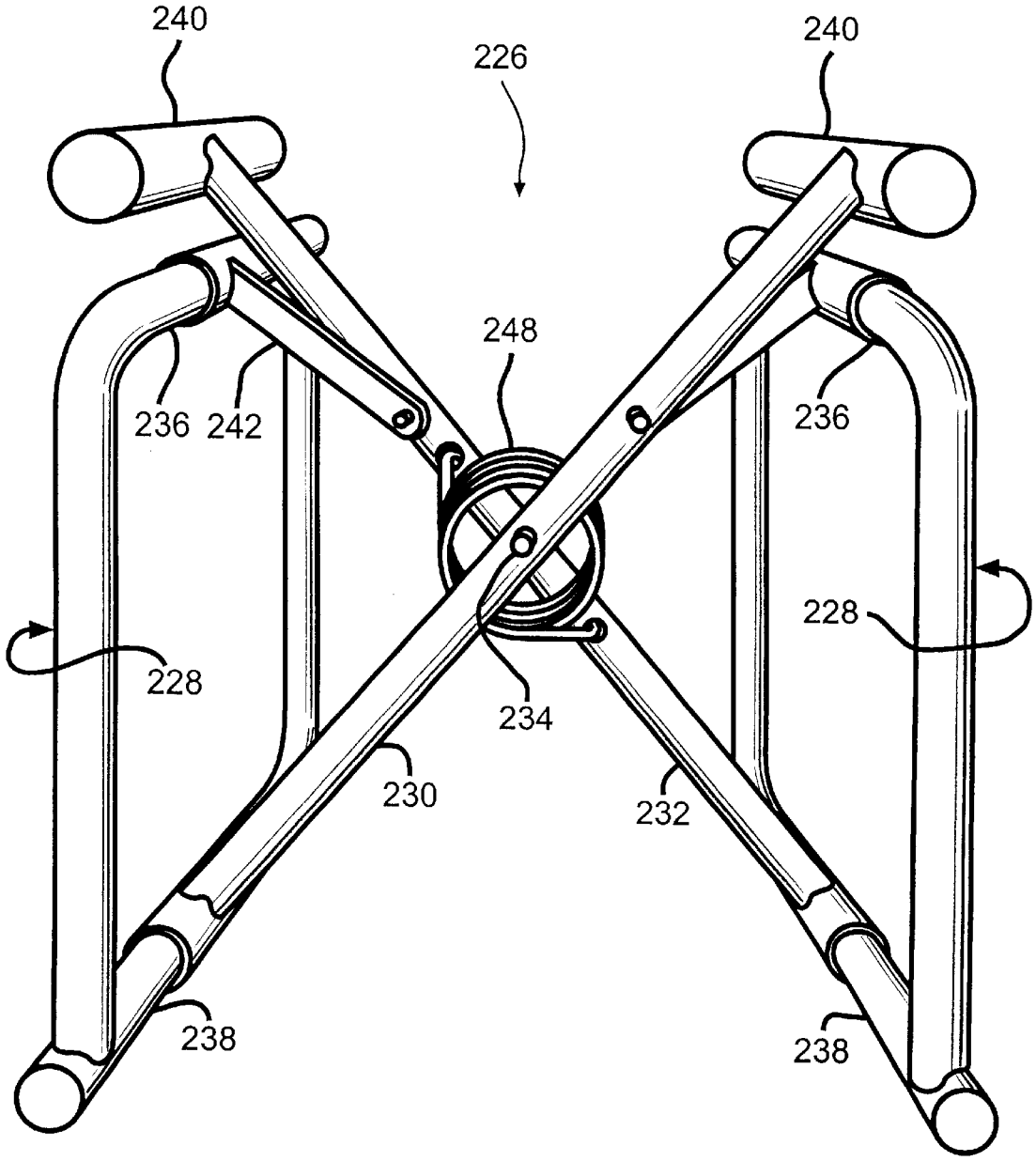
FIG. 20 is a perspective view of another folding mechanism, using a coil spring, according to the invention.
Figure 21:
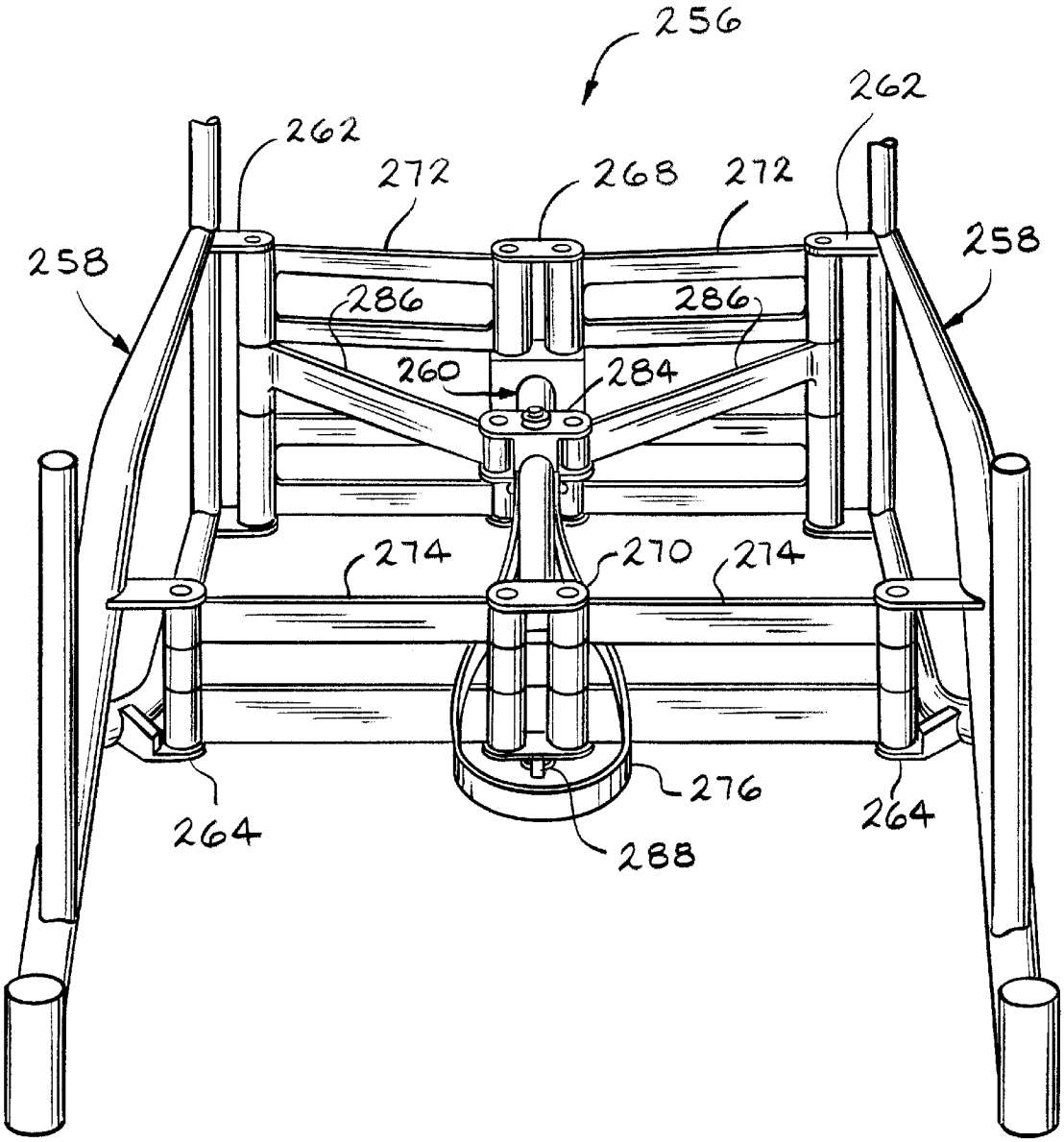
FIG. 21 is front perspective of a wheelchair frame and folding mechanism, according to another embodiment of the invention.
Figure 22:
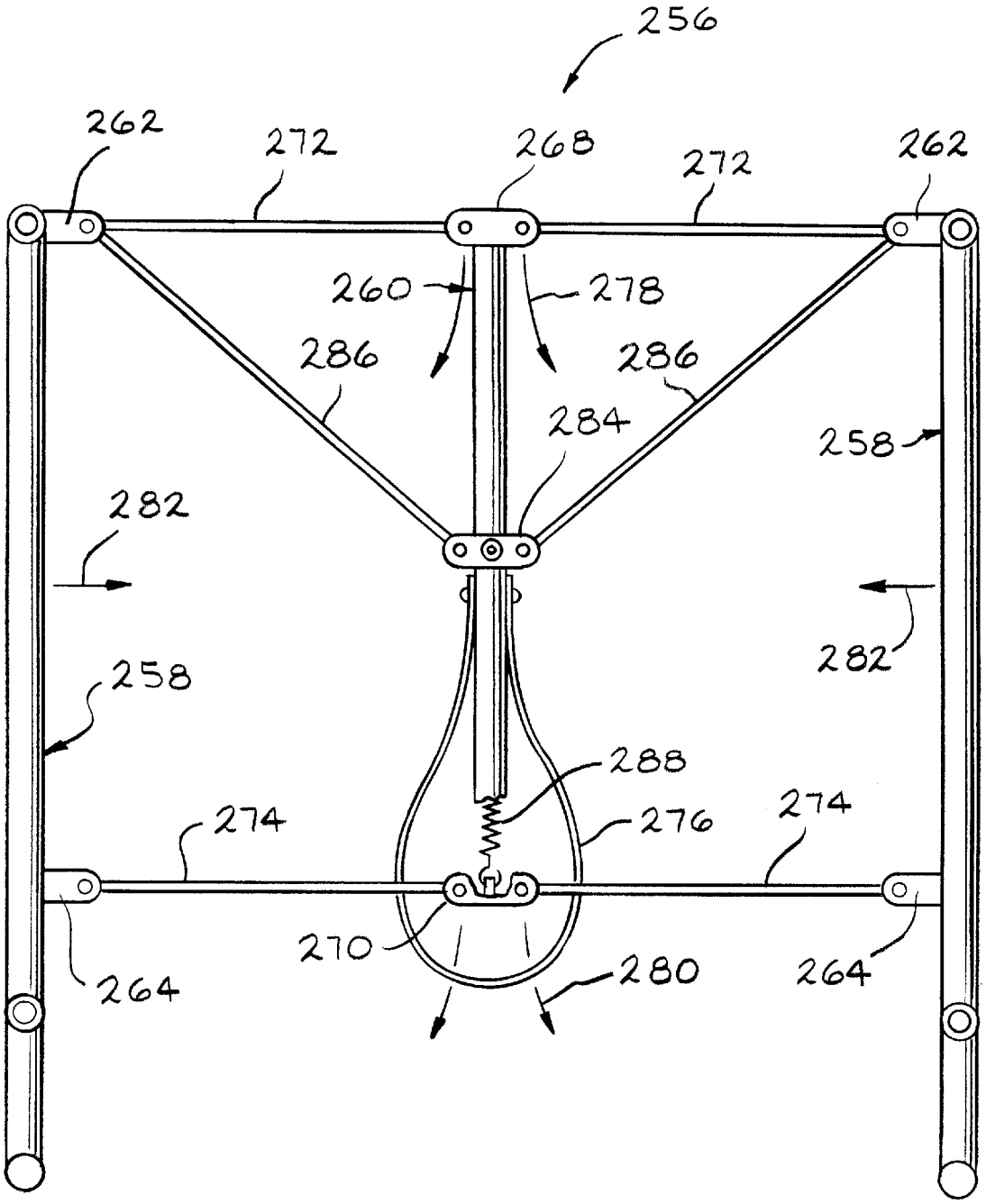
FIG. 22 is a top view of the folding mechanism of FIG. 21.

Likewise, the embodiment shown in FIG. 20 is similar in every manner to that shown in FIG. 18 except that the biasing member is a coil spring 248. When the wheelchair frame 226 is folded toward a closed position, the winding of the coil spring 248 will bias the wheelchair frame toward the open position. In this manner, the bias of the coil spring will assist the wheelchair user in opening the wheelchair.

An additional feature of the invention is a pneumatic damper 250 connected between the cross braces 230, 232 for controlling the speed of opening of the wheelchair, as shown in FIG. 18. The purpose of the damper 250 is to prevent wheelchair frame 226 from opening too fast. The damper can be any suitable device capable of governing the opening of the wheelchair, and can be connected between any two of the numerous different structural parts of the wheelchair frame 226.

As a summarization of the disclosure of the various embodiments of the invention, it can be seen that a biasing member, such as a spring, is used to provide a force to help the wheelchair user to open the wheelchair from a folded or closed position to an open position. The spring or biasing member is connected between two of the wheelchair elements, referred to generally as frame members or first and second frame members. The frame members are movable with respect to each other during folding of the wheelchair, wherein movement of the frame members with respect to each other during folding of the wheelchair creates a biasing force in the biasing member urging the wheelchair to an open position. Examples of frame members include links, such as the links illustrated in FIGS. 1, 2, 8 and 9, plates, such as the plates shown in FIGS. 11 and 12, cross braces connected at a pivot pin, first and second slidable members, such as the slider housing 20 and slider member 22 that are mounted for one to slide within the other, and elongated elements slidably connected to a center mounting block in a rack and pinion arrangement with a central gear, such as those illustrated in FIGS. 13–17.

In yet another embodiment of the invention, as shown in FIGS. 21–24, the wheelchair frame 256 includes side frames 258 and a center guide tube 260. The side frames are provided with rear side frame hinges 262 and forward side frame hinges 264. The center guide tube 260 includes a rear connector 268 and a forward connector 270. The rear connector 268 is linked to the rear side frame hinges 262 by rear pivot links 272. Likewise, the forward connector 270 is linked to the forward side frame hinges 264 by forward pivot links 274. A pull strap 276 is attached to the center guide tube 260. It can be seen that as the center guide tube 260 is pulled in the forward direction with respect to the side frames 258, the rear and forward connectors 268, 270 will move forward, as indicated by the arrows 278, 280, respectively. As the center guide tube 260 is pulled forward, the rear and forward pivot links 272, 274 will draw the side frames 258 toward each other, thereby folding the wheelchair frame 256, as indicated by the directional arrows 282.

Figure 23:
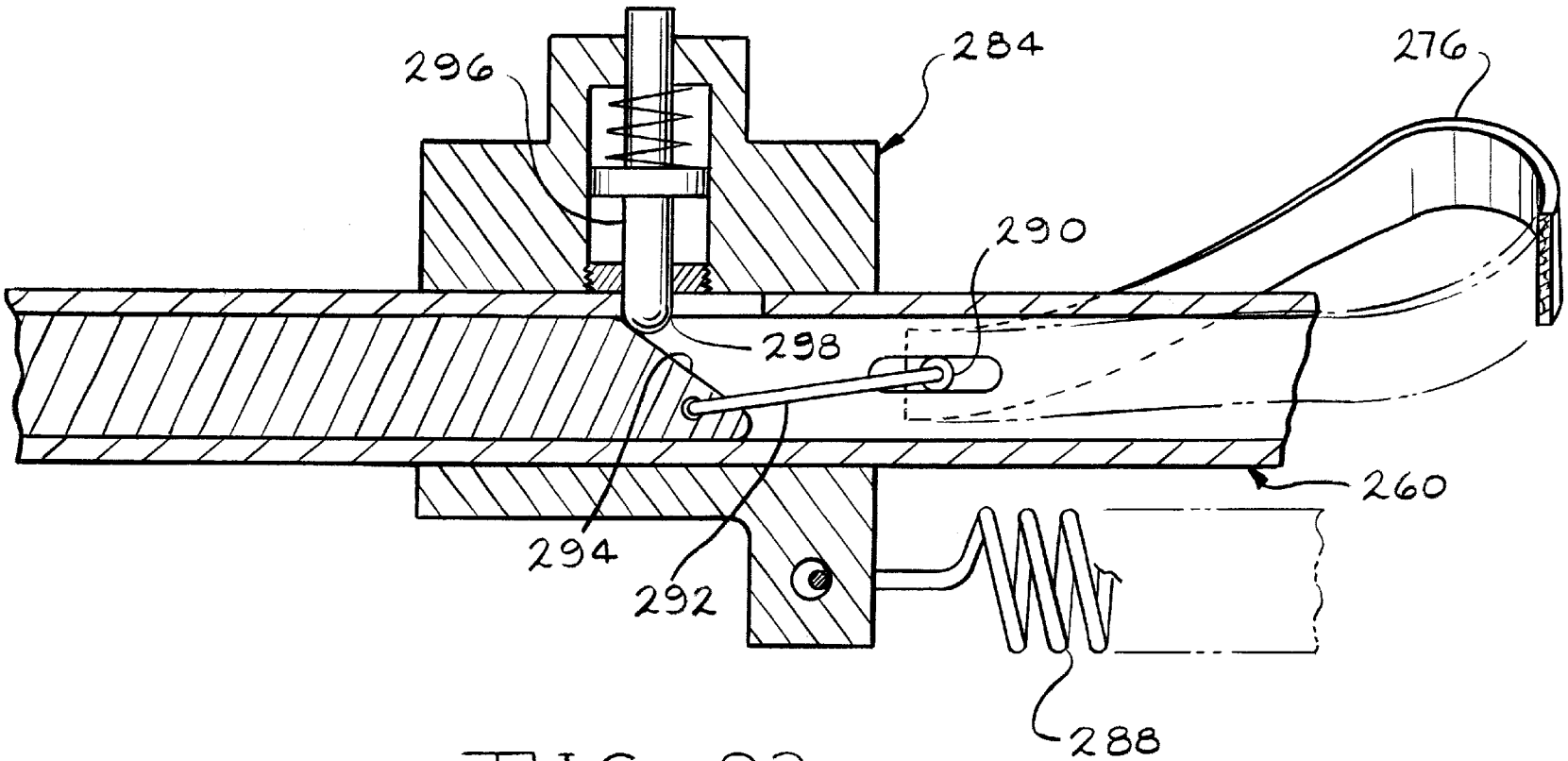
FIG. 23 is a cross-sectional view of the latching mechanism of the molding mechanism of FIG. 21.

A center lock housing 284 is slidably positioned around the center guide tube 260 so that when the center guide tube 260 is pulled relative to the side frames 258 the center guide tube 260 will slide within the center lock housing 284. The center lock housing 284 is connected to the rear side frame hinges 262 by means of guide links 286. A spring 288 is connected between the center lock housing 284 and the forward connector 270. As shown in FIG. 23, the spring 288 is positioned beneath the center guide tube 260, although the spring 288 can be connected in any manner between the center lock housing 284 and the forward connector 270. It can be seen that when the wheelchair frame 256 is folded, the forward movement of the center guide tube 260 relative to the side frames 258 will have the effect of separating the forward connector 270 farther apart from the center lock housing 284. This will extend or stretch the spring 288, thereby providing a biasing force toward opening the wheelchair frame.

As shown in FIG. 23, the strap 276 can be connected to the center guide tube 260 by means of a bolt 290. The bolt 290 is connected with a link 292 to a wedge 294 that is slidable within the center guide tube 260. The center lock housing 284 includes a spring loaded pin 296 that is biased to penetrate an orifice 298 in the center guide tube 260 to lock the wheelchair frame 256 in the open, unfolded position. In operation, as the strap 276 is pulled forward with respect to the center lock housing 284, the forward movement of the wedge 294 will push in the pin 296, thereby releasing the center guide tube 260 for sliding forward through the center lock housing. It can be seen that the spring 288 biases the two frame members, i.e., the center lock housing 284 and the center guide tube 260, so that there is a force urging a return of the wheelchair frame 256 to the open position shown in FIGS. 21–24.

Figure 24:
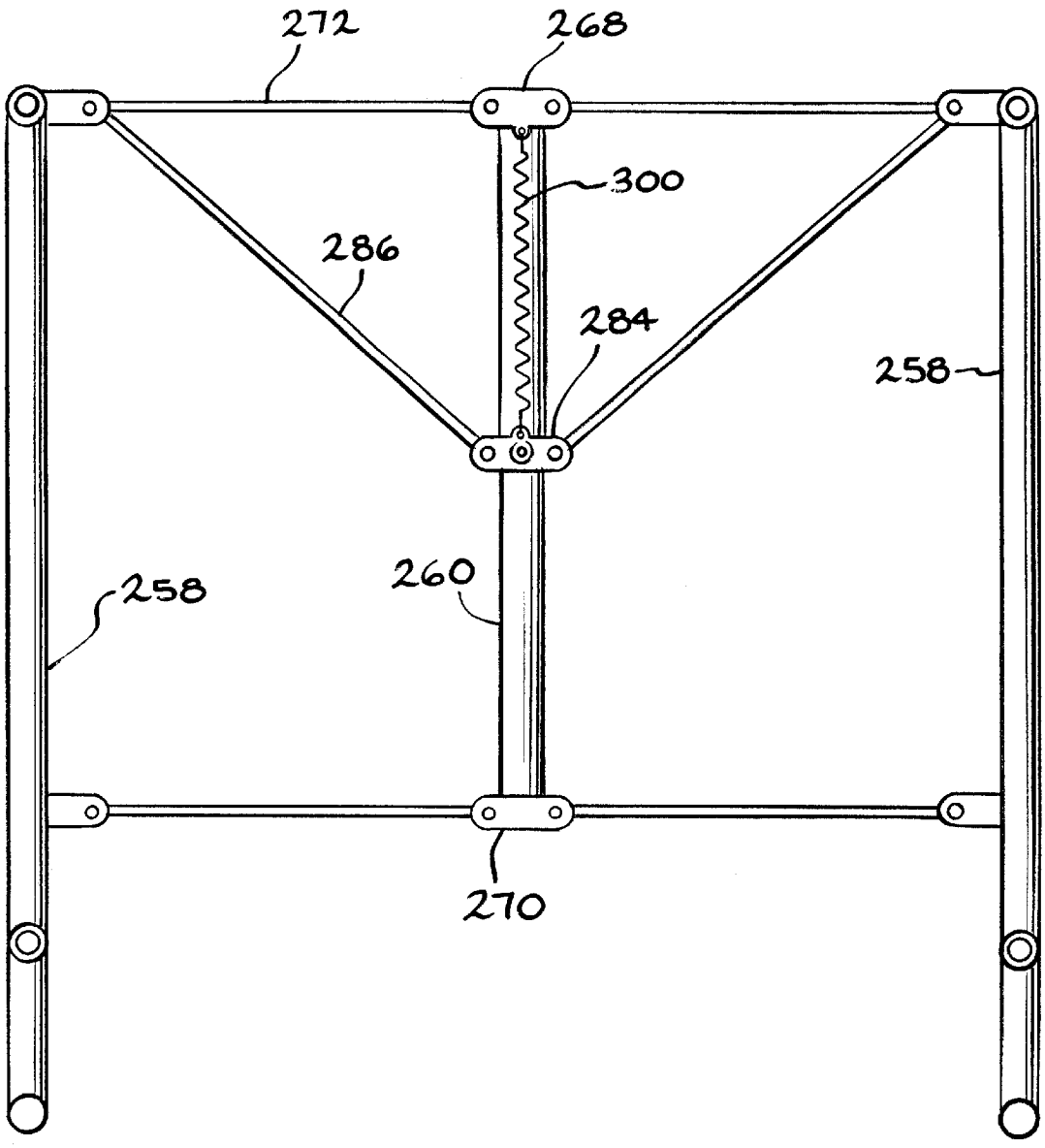
FIG. 24 is a view similar to that of FIG. 22, showing the use of a compression spring.

As shown in FIG. 24, a compression spring 300 can be connected between the rear connector 268 and the 284 center lock housing. It can be seen that when the wheelchair frame 256 is folded, the forward movement of the center guide tube 260 relative to the side frames 258 will have the effect of moving the rear connector 268 closer to the center lock housing 284. This will compress the spring 300, thereby providing a biasing force toward opening the wheelchair frame.

The principle and mode of operation of this invention have been described in its preferred embodiments. However, it should be noted that this invention can be practiced otherwise than as specifically illustrated and described without departing from its scope.

What is claimed is:

1. A wheelchair frame comprising:

first and second side frames;

a slider housing;

a slider member mounted for movement relative to the slider housing;

links connecting the slider housing to both the first and second side frames; and links connecting the slider member to both the first and second side frame side frames;

wherein movement of the slider member relative to the slider housing actuates the links to change the spacing between the first and second side frames, thereby opening and closing the wheelchair frame; and wherein the wheelchair includes a stop configured to establish a maximum extent and a minimum extent to which the slider member can be moved with respect to the slider housing, thereby establishing a minimum and maximum width of the wheelchair frame.

2. The wheelchair frame of claim 1 in which a first pair of links connects the slider housing with the first side frame, a second pair of links connects the slider housing with the second side frame, a third pair of links connects the slider member with the first side frame, and a fourth pair of links connects the slider member with the second side frame.

3. The wheelchair frame of claim 2 in which at least one of the pairs of links is oriented in a configuration wherein both of the links are pivotally mounted at one of the side frames, with one of the links in the pair being pivotally mounted at a pivot point closer to the side frame than the pivot point of the other of the links in the pair.

4. The wheelchair frame of claim 1 including a stop for locking the slider member with respect to the slider housing.

5. The wheelchair frame of claim 1 in which the stop is adjustable with respect to the slider member.

6. The wheelchair frame of claim 5 in which the stop is seated in an orifice that is adjustable to any one of several predetermined locations on the slider member, with each of the locations corresponding to a different width of the wheelchair frame when the wheelchair frame is opened.

7. The wheelchair frame of claim 6 in which the predetermined locations on the slider member are spaced apart in an arrangement that corresponds with widths of the wheelchair frame that are approximately one inch apart from a next adjacent width.

8. The wheelchair frame of claim 1 in which the slider housing includes a stop in the form of a pin, and in which the slider member includes first and second orificed latch members for engagement with the pin, wherein engagement of the pin with the first and second latch members establishes the maximum and minimum extent of movement, respectively, of the slider member with respect to the slider housing.

9. The wheelchair frame of claim 8 in which the slider member is elongated in the forward and rearward direction, and in which the first latch member is adjustable relative to the slider member for attachment at different positions along the length of the slider member.

10. The wheelchair frame of claim 9 in which the slider member has orifices at predetermined positions along the length of the slider member for attachment of the first latch member at predetermined locations on the slider member.

11. The wheelchair frame of claim 10 in which each of the predetermined locations corresponds to a different width of the wheelchair frame when the wheelchair frame is opened.

12. The wheelchair frame of claim 1 wherein the slider housing, slider member, links, and first and second side frames are configured so that the side frames remain parallel to each other as the wheelchair frame opens and closes.

13. The wheelchair frame of claim 1 wherein the slider housing and slider member have triangular cross-sectional shapes.

14. A wheelchair having the wheelchair frame of claim 1.

15. A wheelchair frame comprising:

first and second side frames;

a slider housing;

a slider member mounted for movement relative to the slider housing;

links connecting the slider housing to both the first and second side frames; and links connecting the slider member to both the first and second side frame side frames;

wherein movement of the slider member relative to the slider housing actuates the links to change the spacing between the first and second side frames, thereby opening and closing the wheelchair frame; and wherein a first pair of links connects the slider housing with the first side frame, a second pair of links connects the slider housing with the second side frame, a third pair of links connects the slider member with the first side frame, and a fourth pair of links connects the slider member with the second side frame.

16. A wheelchair frame comprising:

first and second side frames;

a slider housing;

a slider member mounted for movement relative to the slider housing;

links connecting the slider housing to both the first and second side frames;

links connecting the slider member to both the first and second side frame side frames; and a stop in the form of a pin for limiting the extent to which the slider member can be moved with respect to the slider housing, thereby establishing a minimum and maximum width of the wheelchair frame, the stop being seated in an orifice that is adjustable to any one of several predetermined locations on the slider member, with each of the locations corresponding to a different width of the wheelchair frame when the wheelchair frame is opened;

wherein movement of the slider member relative to the slider housing actuates the links to change the spacing between the first and second side frames, thereby opening and closing the wheelchair frame.

17. The wheelchair frame of claim 16 in which the slider member includes first and second orificed latch members for engagement with the pin, wherein engagement of the pin with the first and second latch members establishes the maximum and minimum extent of movement, respectively, of the slider member with respect to the slider housing.

18. The wheelchair frame of claim 17 in which the slider member has orifices at predetermined positions along the length of the slider member for attachment of the first latch member at predetermined locations on the slider member.

19. A wheelchair having the wheelchair frame of claim 16.

20. A wheelchair frame comprising:

first and second side frames;

a slider housing;

a slider member mounted for movement relative to the slider housing;

links connecting the slider housing and the slider member to both the first and second side frames; and a biasing member connecting the slider housing and the slider member;

wherein the biasing member biases the slider housing and slider member toward each other, and wherein actuation of the links changes the spacing between the first and second side frames, thereby opening and closing the wheelchair frame, with the biasing member acting to open the wheelchair frame; and wherein the wheelchair includes a stop configured to establish a maximum extent and a minimum extent to which the slider member can be moved with respect to the slider housing, thereby establishing a minimum and maximum width of the wheelchair frame.

21. The wheelchair frame of claim 20 in which the stop is seated in an orifice that is adjustable to any one of several predetermined locations on the slider member, with each of the locations corresponding to a different width of the wheelchair frame when the wheelchair frame is opened.

22. The wheelchair frame of claim 21 in which the stop is in the form of a pin, and in which the slider member includes first and second orificed latch members for engagement with the pin, wherein engagement of the pin with the first and second latch members establishes the maximum and minimum extent of movement, respectively, of the slider member with respect to the slider housing.

23. The wheelchair frame of claim 20 wherein the slider housing and slider member have triangular cross-sectional shapes.

24. A wheelchair having the wheelchair frame of claim 20.

25. A wheelchair frame comprising:

first and second side frames;

a slider housing;

a slider member mounted for movement relative to the slider housing;

links connecting the slider housing to both the first and second side frames; and links connecting the slider member to both the first and second side frame side frames;

wherein movement of the slider member relative to the slider housing actuates the links to change the spacing between the first and second side frames, thereby opening and closing the wheelchair frame;

wherein a first pair of links connects the slider housing with the first side frame, a second pair of links connects the slider housing with the second side frame, a third pair of links connects the slider member with the first side frame, and a fourth pair of links connects the slider member with the second side frame; and wherein at least one of the pairs of links is oriented in a configuration in which both of the links are pivotally mounted at one of the side frames, with one of the links in the pair being pivotally mounted at a pivot point closer to the side frame than the pivot point of the other of the links in the pair.

26. A wheelchair frame comprising:

first and second side frames;

a slider positioned between the side frames, the slider being mounted for movement in forward and rearward directions with respect to the side frames; and links connecting the slider to both the side frames so that movement of the slider relative to the side frames changes the spacing between the side frames, thereby opening and closing the wheelchair frame, with the links being mounted in at least three separate horizontal planes on the right side of the wheelchair, and the links being mounted in at least three separate horizontal planes on the left side of the wheelchair.

27. The wheelchair frame of claim 26 in which the slider comprises a slider housing and a slider member, with the slider member being mounted for sliding movement within the slider housing.

28. A wheelchair frame comprising:

first and second side frames;

a slider positioned between the side frames, the slider being mounted for movement in forward and rearward directions with respect to the side frames;

links connecting the slider to both the side frames so that movement of the slider relative to the side frames changes the spacing between the side frames, thereby opening and closing the wheelchair frame; and a biasing member connected to the slider;

wherein the biasing member biases the slider in a direction to open the wheelchair frame; and wherein the wheelchair includes a stop configured to establish a maximum extent and a minimum extent to which the slider member can be moved with respect to the side frames, thereby establishing a minimum and maximum width of the wheelchair frame.

29. A wheelchair frame comprising:

first and second side frames;

a slider housing;

a slider member mounted for movement relative to the slider housing;

links connecting the slider housing to both the first and second side frames, wherein both the slider housing and slider member have triangular cross-sectional shapes; and links connecting the slider member to both the first and second side frame side frames;

wherein movement of the slider member relative to the slider housing actuates the links to change the spacing between the first and second side frames, thereby opening and closing the wheelchair frame.

* * * * *